US007396212B1

(12) United States Patent
Parker et al.

(10) Patent No.: US 7,396,212 B1
(45) **Date of Patent: *Jul. 8, 2008**

(54) HIGH EFFICIENCY TWISTED LEAF BLADE CEILING FAN

(75) Inventors: Danny S. Parker, Coca Beach, FL (US); Thomas Zambrano, Long Beach, CA (US); Taras Kiceniuk, Jr., Santa Paula, CA (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 238 days.

This patent is subject to a terminal disclaimer.

(21) Appl. No.: 11/341,280

(22) Filed: Jan. 27, 2006

Related U.S. Application Data

(60) Continuation-in-part of application No. 11/027,242, filed on Dec. 31, 2004, now Pat. No. 7,210,910, which is a division of application No. 10/121,388, filed on Apr. 12, 2002, now Pat. No. 6,884,034, and a continuation-in-part of application No. 09/976,515, filed on Oct. 12, 2001, now Pat. No. 6,659,721, and a continuation-in-part of application No. 09/711,599, filed on Nov. 13, 2000, now Pat. No. 6,415,984, which is a division of application No. 09/415,883, filed on Oct. 8, 1999, now Pat. No. 6,189,799, which is a division of application No. 09/067,236, filed on Apr. 27, 1998, now Pat. No. 5,996,898, which is a continuation-in-part of application No. 09/056,428, filed on Apr. 7, 1998, now Pat. No. 6,039,541.

(60) Provisional application No. 60/342,564, filed on Dec. 26, 2001, provisional application No. 60/265,241, filed on Jan. 31, 2001.

(51) Int. Cl.
*F04D 29/38* (2006.01)

(52) U.S. Cl. ..... 416/243; 416/223 R

(58) Field of Classification Search ..... 416/5, 416/170 R, 210 R, 223 R, 243, DIG. 5
See application file for complete search history.

(56) References Cited

U.S. PATENT DOCUMENTS

| | | | |
|---|---|---|---|
| 1,506,937 | A | 9/1924 | Miller |
| 1,903,823 | A | 4/1933 | Lougheed |
| 1,942,688 | A | 3/1934 | Davis |

(Continued)

FOREIGN PATENT DOCUMENTS

| | | |
|---|---|---|
| AU | 19987 | 5/1929 |

(Continued)

*Primary Examiner*—Nihn H Nguyen
(74) *Attorney, Agent, or Firm*—Brian S. Steinberger; Law Offices of Brian S. Steinberger, P.A.

(57) ABSTRACT

Twisted leaf shaped ceiling fan blades for low, medium and high speed operation of less than approximately 250 rpm. The novel blades twisted blades can be configured for 52", 54", 56", 60" and 64" diameter fans, and have less blades (3 for example) than conventional flat type bladed fans having 4, 5 blades and have greater air flow and less power draw results than the conventional flat 54 inch fans. Any of the novel twisted blades of 48", 52", 54", 56", 60" and 64" can be run at reduced speeds, drawing less Watts than conventional fans and still perform better with more air flow and less problems than conventional flat type conventional leaf shaped blades.

19 Claims, 32 Drawing Sheets

U.S. PATENT DOCUMENTS

| | | | | |
|---|---|---|---|---|
| 2,283,956 | A | 4/1942 | Smith | 170/159 |
| 2,345,047 | A | 3/1944 | Houghton | 170/162 |
| 2,450,440 | A | 10/1948 | Mills | 170/159 |
| 2,682,925 | A | 7/1954 | Wosika | 170/159 |
| 4,197,057 | A | 4/1980 | Hayashi | 416/242 |
| 4,325,675 | A | 4/1982 | Gallot et al. | 416/223 |
| 4,411,598 | A | 10/1983 | Okada | 416/223 |
| 4,416,434 | A | 11/1983 | Thibert et al. | 244/35 |
| 4,693,673 | A * | 9/1987 | Nee | 416/199 |
| 4,730,985 | A | 3/1988 | Rothman et al. | 416/228 |
| 4,782,213 | A | 11/1988 | Teal | 219/372 |
| 4,844,698 | A | 7/1989 | Gornstein et al. | 416/223 |
| 4,892,460 | A | 1/1990 | Volk | 416/62 |
| 4,974,633 | A | 12/1990 | Hickey | 137/561 |
| 5,033,113 | A | 7/1991 | Wang | 455/603 |
| 5,114,313 | A | 5/1992 | Vorus | 416/93 |
| RE34,109 | E | 10/1992 | Gornstein et al. | 416/223 |
| 5,244,349 | A | 9/1993 | Wang | 416/231 |
| 5,253,979 | A | 10/1993 | Fradenburgh et al. | 416/223 |
| 5,328,329 | A | 7/1994 | Monroe | 416/62 |
| D355,027 | S | 1/1995 | Young | D23/377 |
| D364,224 | S | 11/1995 | Wang | D23/377 |
| D371,838 | S | 7/1996 | Davis, Jr. et al. | D23/411 |
| D378,404 | S | 3/1997 | Jaspers-Fayer | D23/377 |
| D382,636 | S | 8/1997 | Yang | D23/377 |
| D387,156 | S | 12/1997 | Johnson | D23/411 |
| D402,026 | S | 12/1998 | Chuang et al. | D23/377 |
| 5,860,788 | A | 1/1999 | Sorensen | 416/189 |
| D408,518 | S | 4/1999 | Liu | D23/377 |
| D412,571 | S | 8/1999 | Lee | D23/377 |
| 5,951,162 | A | 9/1999 | Weetman et al. | 366/328.1 |
| D414,856 | S | 10/1999 | Zuege | D23/377 |
| D421,799 | S | 3/2000 | Zuege | D23/411 |
| D422,072 | S | 3/2000 | Blateri | D23/377 |
| 6,039,533 | A | 3/2000 | McCabe | 415/146 |
| 6,039,541 | A | 3/2000 | Parker et al. | 416/223 |
| 6,146,097 | A * | 11/2000 | Bradt | 416/5 |
| D443,352 | S | 6/2001 | Lantz | D23/413 |
| 6,244,821 | B1 | 6/2001 | Boyd et al. | 416/210 |
| 6,254,476 | B1 | 7/2001 | Choi | 454/329 |
| D451,997 | S | 12/2001 | Schwartz | D23/413 |
| D453,566 | S | 2/2002 | Lantz | D23/413 |
| D454,636 | S | 3/2002 | Lantz | D23/413 |
| D469,950 | S | 2/2003 | Scalise et al. | D3/3 |
| D480,471 | S | 10/2003 | Hsieh | D23/411 |
| D480,473 | S | 10/2003 | Thomas, Jr. | D23/413 |
| D484,233 | S | 10/2003 | Bucher et al. | D23/377 |
| 6,659,721 | B1 | 12/2003 | Parker et al. | 416/5 |
| D485,345 | S | 1/2004 | Bucher | D23/377 |
| D485,346 | S | 1/2004 | Bucher et al. | D23/377 |
| D485,347 | S | 1/2004 | Bucher et al. | D23/377 |
| 6,719,532 | B2 | 4/2004 | Bird | 416/210 |
| 6,719,533 | B2 | 4/2004 | Bird | 416/210 |
| 6,733,241 | B2 | 5/2004 | Bird | 416/238 |
| D491,657 | S | 6/2004 | Cartwright | D23/413 |
| 6,884,034 | B1 | 4/2005 | Parker et al. | 416/1 |
| 6,890,155 | B2 | 5/2005 | Cartwright | 416/229 |
| 6,923,624 | B2 | 8/2005 | Tsai | 416/231 |
| D510,992 | S | 10/2005 | Bucher | D23/377 |
| 6,968,953 | B2 * | 11/2005 | Humphrey | 206/576 |
| 7,210,910 | B1 * | 5/2007 | Parker et al. | 416/243 |

FOREIGN PATENT DOCUMENTS

| | | |
|---|---|---|
| FR | 1050902 | 1/1954 |
| GB | 676409 | 7/1952 |
| GB | 925931 | 5/1963 |

* cited by examiner

18°
HP
CL
.35"
CL
ALE
A
2
ATE

13°
HP
CL
.35"
CL
BLE
B
2
BTE
9°

10°
HP
CL
CL
.35"
CLE
C
2
CTE
13°

5°
DLE
D
4
2
CL
HP
CL
.35"
DTE
7°

4°
ELE
.35"
E
4
2
CL
HP
CL
ETE
1°

14°
FLE
4
2
F
CL
HP
CL
.35"
FTE

HIGH EFFICIENCY TWISTED LEAF BLADE CEILING FAN

This invention is a Continuation-In-Part of application Ser. No. 11/027,242 filed Dec. 31, 2004 now U.S. Pat. No. 7,210,910, which is a divisional application of Ser. No. 10/121,388 filed Apr. 12, 2002 now U.S. Pat. No. 6,884,034 which claims the benefit of priority to Provisional Application 60/342,564 filed Dec. 26, 2001, is a Continuation-In-Part of U.S. application Ser. No. 09/976,515 filed Oct. 12, 2001, now U.S. Pat. No. 6,659,721, which claims the benefit of Provisional Application 60/265,241 filed Jan. 31, 2001, and is a continuation-in-part of U.S. Ser. No. 09/711,599 filed Nov. 13, 2000, now U.S. Pat. No. 6,415,984, which is a divisional application of U.S. Ser. No. 09/415,883 filed Oct. 8, 1999 now U.S. Pat. No. 6,189,799, which is a divisional application of U.S. Ser. No. 09/067,236 filed Apr. 27, 1998 now U.S. Pat. No. 5,996,898 which is incorporated by reference, which is a continuation-in-part of U.S. Ser. No. 09/056,428 filed Apr. 7, 1998 now U.S. Pat. No. 6,039,541 all of which are incorporated by reference.

FIELD OF INVENTION

This invention relates to ceiling fans, and in particular to twisted leaf shaped blades formed from wood and/or plastic that run at reduced energy consumption with larger air movement volumes than traditional leaf shaped ceiling fan blades, and to methods of operating twisted leaf shaped ceiling fans.

BACKGROUND AND PRIOR ART

Circulating air by using aesthetically pleasing design fan blades has been done for many years. Leaf shaped flat type blades have become popular in recent years. See for example, U.S. patents: U.S. Pat. No. D387,156 to Johnson; U.S. Pat. No. D443,352 and U.S. Pat. No. D454,636 to Lantz; U.S. Pat. No. D485,345 and U.S. Pat. No. D510,992 to Bucher; U.S. Pat. No. D491,657 and U.S. Pat. No. 6,890,155 to Cartwright; and U.S. Pat. No. 6,923,624 to Tsai. Another popular blade style over the years is a flat planar rectangular blade that can have a slight tilt, as shown for example in U.S. patents: U.S. Pat. No. Des. 355,027 to Young and U.S. Pat. No. Des. 382,636 to Yang. These patents while moving air are not concerned with maximizing optimum downward airflow.

Furthermore, many of the flat ceiling fan blades have problems such as poor performance at high speeds, wobbling, and excessive noise that is noticeable to persons in the vicinity of the fan blades.

Also, the older design prior art leaf shaped ceiling fan blades are more prone to wobble and noise as the lift produced is non-uniform across the length of the blades.

Aircraft, marine and automobile engine propeller type blades have been altered over the years to shapes other than flat rectangular. See for example, U.S. Pat. No. 1,903,823 to Lougheed; U.S. Pat. No. 1,942,688 to Davis; U.S. Pat. No. 2,283,956 to Smith; U.S. Pat. No. 2,345,047 to Houghton; U.S. Pat. No. 2,450,440 to Mills; U.S. Pat. No. 4,197,057 to Hayashi; U.S. Pat. No. 4,325,675 to Gallot et al.; U.S. Pat. No. 4,411,598 to Okada; U.S. Pat. No. 4,416,434 to Thibert; U.S. Pat. No. 4,730,985 to Rothman et al. U.S. Pat. No. 4,794,633 to Hickey; U.S. Pat. No. 4,844,698 to Gornstein; U.S. Pat. No. 5,114,313 to Vorus; and U.S. Pat. No. 5,253,979 to Fradenburgh et al.; Australian Patent 19,987 to Eather. However, these patents are describing devices that are generally used for high speed water, aircraft, and automobile applications where the propellers are run at high revolutions per minute (rpm) generally in excess of 500 rpm. None of these propellers are designed for optimum airflow at low speeds of less than approximately 200 rpm which is the desired speeds used in overhead ceiling fan systems.

Some alternative blade shapes have been proposed for other types of fans. See for example, U.S. Pat. No. 1,506,937 to Miller; U.S. Pat. No. 2,682,925 to Wosik; U.S. Pat. No. 4,892,460 to Volk; U.S. Pat. No. 5,244,349 to Wang; Great Britain Patent 676,406 to Spencer; and PCT Application No. WO 92/07192.

Miller '937 requires that their blades have root "lips 26" FIG. 1 that overlap one another, and would not be practical or useable for three or more fan blade operation for a ceiling fan. Wosik '925 describes "fan blades . . . particularly adapted to fan blades on top of cooling towers such for example as are used in oil refineries and in other industries . . . ", column 1, lines 1-5, and does not describe any use for ceiling fan applications. The Volk '460 patent by claiming to be "aerodynamically designed" requires one curved piece to be attached at one end to a conventional planar rectangular blade. Using two pieces for each blade adds extreme costs in both the manufacturing and assembly of the ceiling itself. Furthermore, the grooved connection point in the Volk devices would appear to be susceptible to separating and causing a hazard to anyone or any property beneath the ceiling fan itself. Such an added device also has necessarily less than optimal aerodynamic properties.

Tilted type design blades have also been proposed over the years. See for example, U.S. Pat. No. D451,997 to Schwartz.

However, none of the prior art modifies design shaped blades to optimize twist angles to optimize energy consumption and airflow, and reduce wobble and noise problems Thus, the need exists for better performing leaf shaped ceiling fan blades over the prior art.

SUMMARY OF THE INVENTION

The first objective of the subject invention is to provide aesthetic ceiling fan blades having leaf shapes that are aerodynamically optimized to move up to approximately 40% or more air than traditional flat planar ceiling fan blades.

The second objective of the subject invention is to provide aesthetic ceiling fan blades having leaf shapes that are more quiet and provide greater comfort than traditional flat planar ceiling fan blades.

The third objective of the subject invention is to provide aesthetic ceiling fan blades having leaf shapes that are less prone to wobble than traditional flat planar ceiling fan blades.

The fourth objective of the subject invention is to provide aesthetic ceiling fan blades having leaf shapes that reduce electrical power consumption and are more energy efficient over traditional flat planar ceiling fan blades.

The fifth objective of the subject invention is to provide aesthetic ceiling fan blades having leaf shapes designed for superior airflow at up to approximately 240 revolutions and more per minute (rpm).

The sixth objective of the subject invention is to provide aesthetic ceiling fan blades having leaf shapes that are more aesthetically appealing than traditional flat planar ceiling fan blades.

The seventh objective of the subject invention is to provide aesthetic ceiling fan blades having leaf shapes capable of reduced low operational speeds for reverse operation to less than approximately 40 revolutions per minute.

The eighth objective of the subject invention is to provide aesthetic ceiling fan blades having leaf shapes with capable of reduced low operational forward speeds of less than approximately 75 revolutions per minute.

The ninth objective of the subject invention is to provide aesthetic ceiling fan blades having leaf shapes with reduced medium operational forward speeds of up to approximately 120 revolutions per minute, that can use less than approximately 9 Watts at low speeds.

The tenth objective of the subject invention is to provide aesthetic ceiling fan blades having leaf shapes that can have up to approximately 64 (sixty four) inch diameter (tip-to-tip fan diameter) or more for enhancing air moving efficiency at lower speeds than conventional fans.

The eleventh objective of the subject invention is to provide aesthetic ceiling fan blades having leaf shapes that can move air over large coverage areas compared to conventional blades.

The twelfth objective of the subjective invention is to provide aesthetic ceiling fan blades having leaf shapes where the altered twist and air foil design is as attractive or more attractive than standard existing planar leaf shaped blades.

A preferred embodiment can include a plurality of aerodynamically leaf shaped blades attached a ceiling fan motor. Each blade can have a twisted between the root end and the tip end and can move greater amounts of air then nonaerodynamically leaf shaped blades. Diameter sizes of the fans can include but not be limited to less than and up to approximately 48", 52", 54", 56", 60", 64", and greater. The blades can be made from wood, plastic, and the like.

Methods of operating the ceiling fan can include the steps of providing twisted leaf shaped blades attached to a ceiling fan motor, rotating the twisted leaf shaped blades relative to the motor, generating an airflow of at least approximately 1,250 cfm (cubic feet per minute) below the rotating blades, running the ceiling fan with the twisted leaf shaped blades with the motor at an efficiency of at least approximately 155 CFM per watt. The fan can be run at speeds up to approximately 250 RPM.

Another method of operating the ceiling fan can include the steps of providing twisted leaf shaped blades attached to a ceiling fan motor, rotating the twisted leaf shaped blades relative to the motor, generating an airflow of at least approximately 3,000 cfm (cubic feet per minute) below the rotating blades, and running the ceiling fan with the twisted leaf shaped blades with the motor at an efficiency of at least approximately 100 CFM per watt. The fan can be run at speeds up to approximately 250 RPM.

A still another method of operating a ceiling fan can include the steps of providing twisted leaf shaped blades attached to a ceiling fan motor, rotating the twisted leaf shaped blades relative to the motor, generating an airflow of at least approximately 5,000 cfm (cubic feet per minute) below the rotating blades, and running the ceiling fan with the twisted leaf shaped blades with the motor at an efficiency of at least approximately 75 CFM per watt. The fan can be run at speeds up to approximately 250 RPM.

A still another method of operating a ceiling fan can include the steps of providing aerodynamically leaf shaped blades attached to a ceiling fan motor, rotating the aerodynamically leaf shaped blades, generating air flow at least approximately 10% above nonaerodynamical leaf shaped blades, and increasing airflow efficiency at least approximately 10% above nonaerodynamical leaf shaped blades.

The generating air flow can also be at least approximately 19% above nonaerodynamical leaf shaped blades, and the increasing airflow efficiency can be at least approximately 19% above nonaerodynamical leaf shaped blades.

The generating air flow can also be at least approximately 50% above nonaerodynamical leaf shaped blades, and the increasing airflow efficiency can be at least at least approximately 50% above nonaerodynamical leaf shaped blades.

The generating air flow can also be at least approximately 55% above nonaerodynamical leaf shaped blades, and the increasing airflow efficiency can be at least approximately 55% above nonaerodynamical leaf shaped blades.

Twisted leaf shaped blades can be provided as the aerodynamically leaf shaped blades. The blades can have concave bends, convex bends and combinations of concave and convex bends that form general S cross-sectional shapes that together optimize airflow.

Further objects and advantages of this invention will be apparent from the following detailed descriptions of the presently preferred embodiments which are illustrated schematically in the accompanying drawings.

BRIEF DESCRIPTION OF THE FIGURES

First Embodiment Twisted Leaf Blades

Second Embodiment Twisted Leaf Blades

Figure 7A:
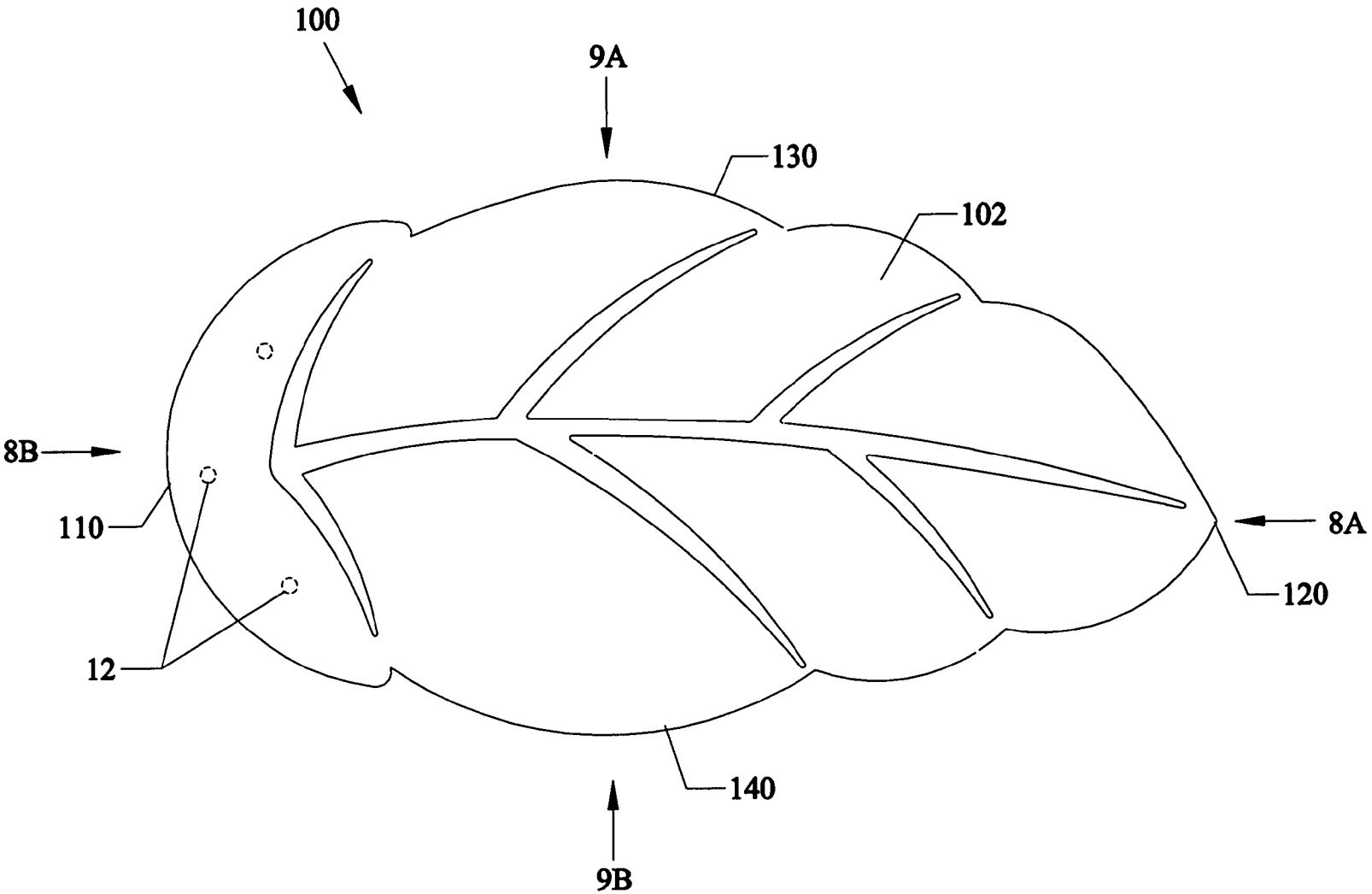

FIG. 7A is a bottom perspective view of a second embodiment twisted leaf ceiling fan blade.

Figure 7B:
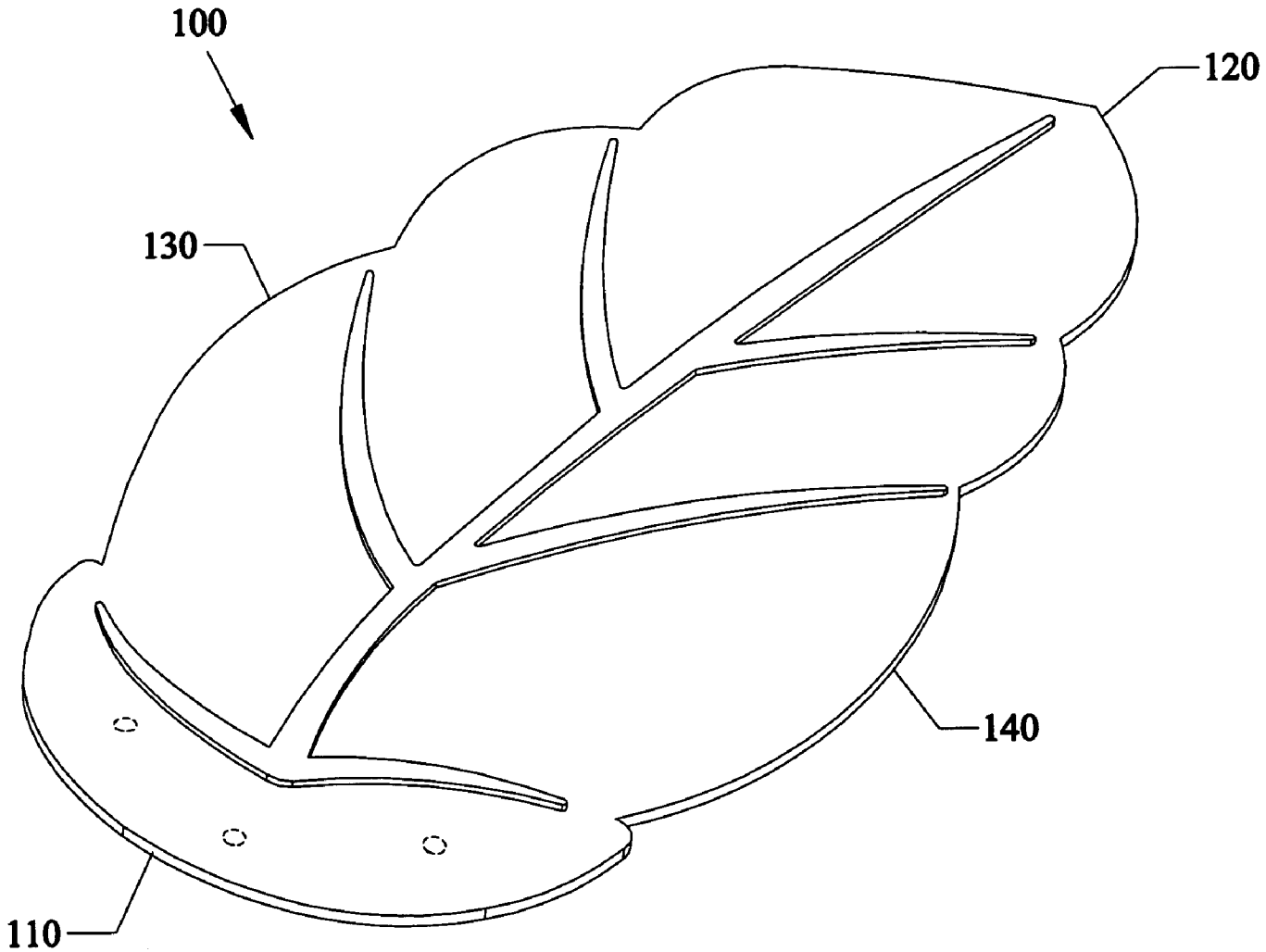

FIG. 7B is a bottom right root end perspective view of the twisted blade of FIG. 7A.

Figure 7C:
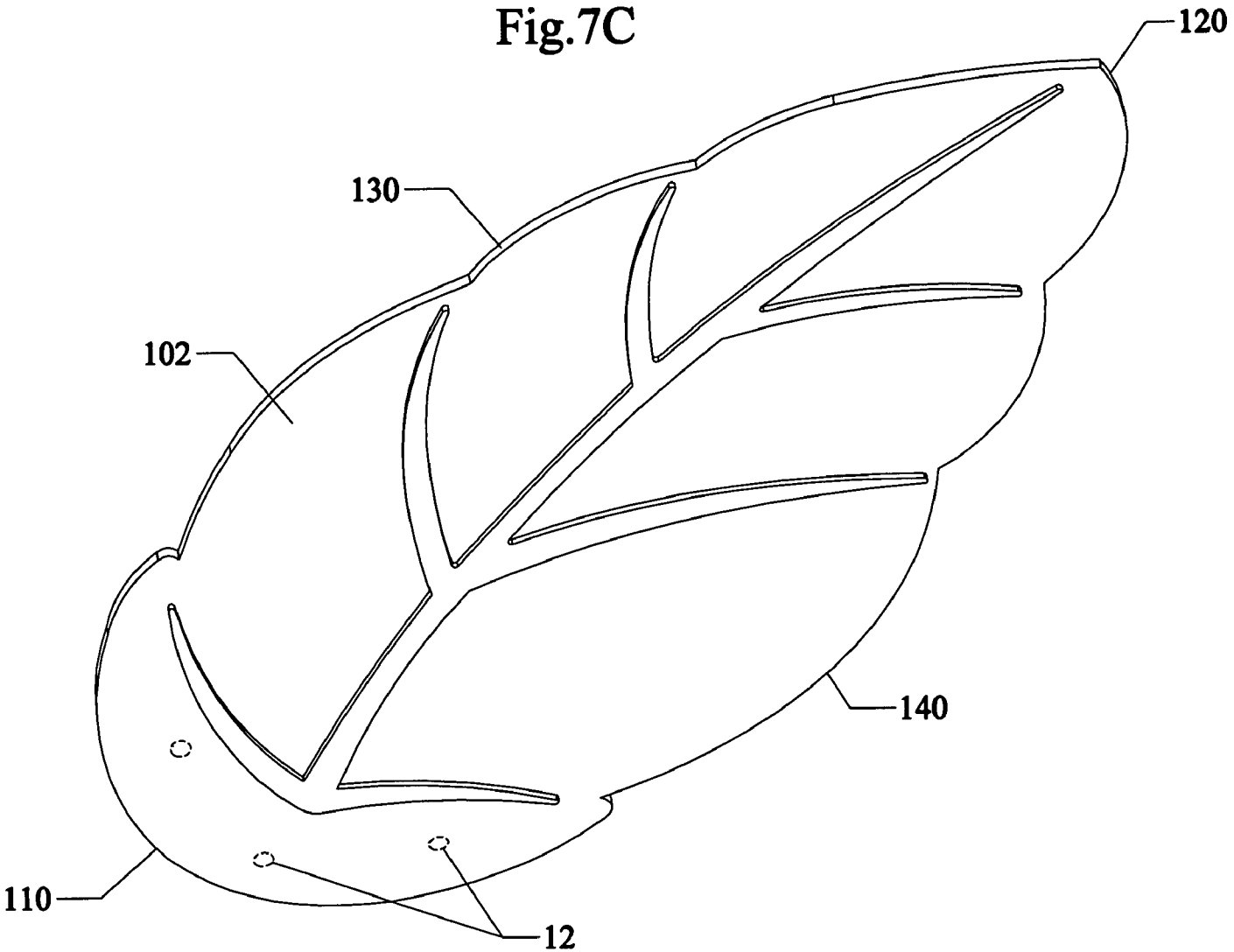

FIG. 7C is a bottom left root end perspective view of the twisted blade of FIG. 7A.

Figure 7D:
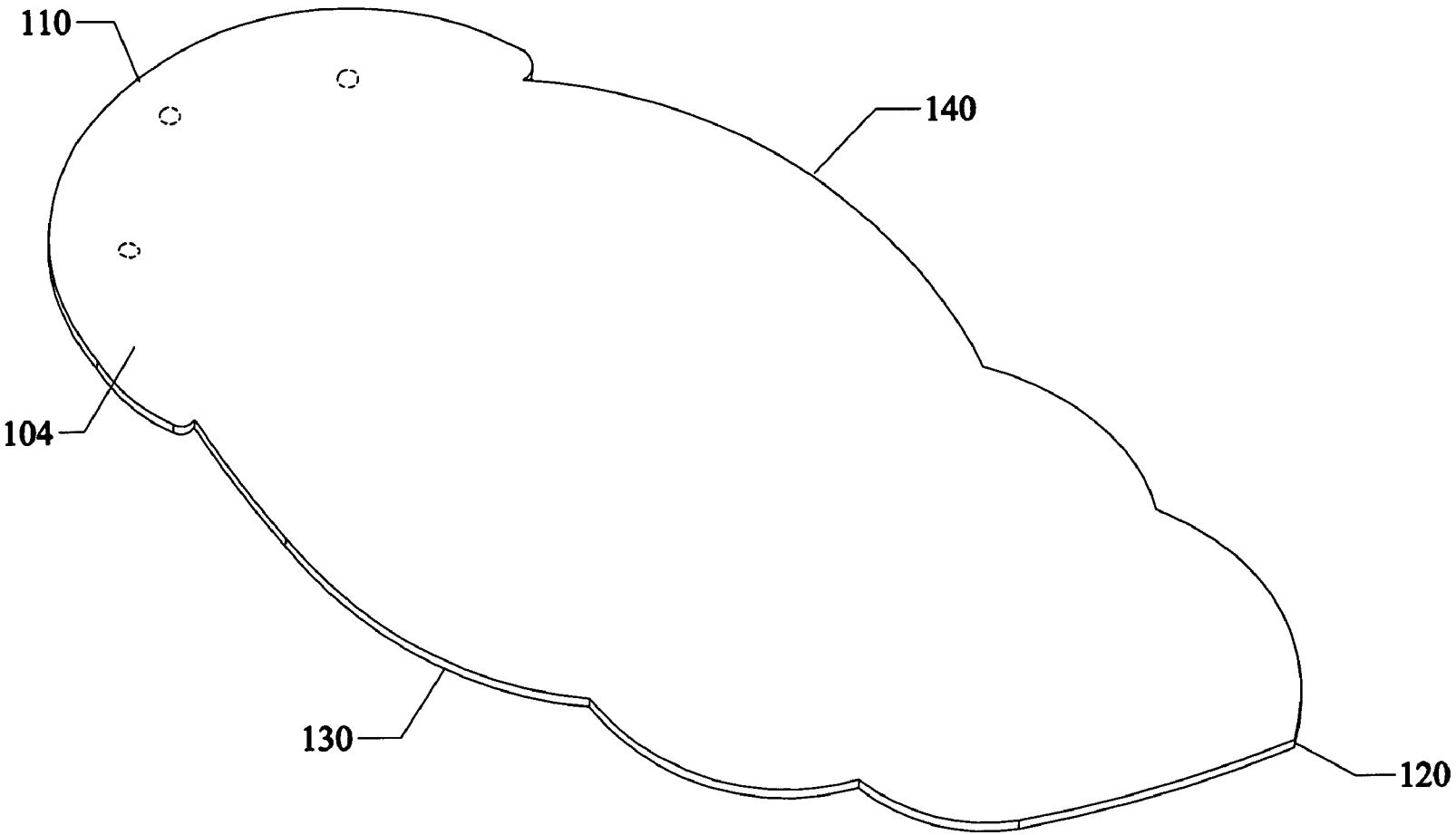

FIG. 7D is a top right tip end perspective view of the twisted blade of FIG. 7A.

Figure 8A:
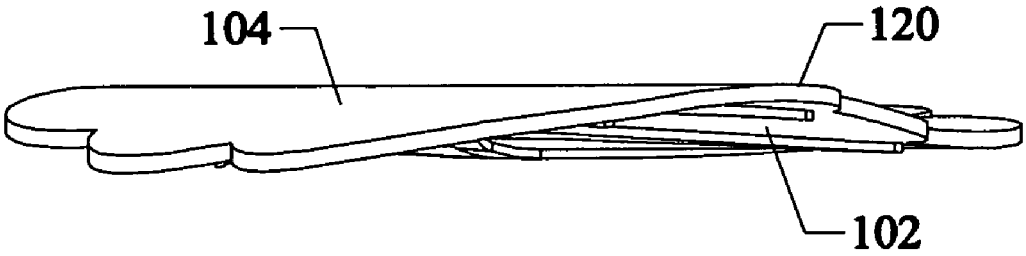

FIG. 8A is a tip end side perspective view of the twisted blade of FIG. 7A along arrow 8A.

Figure 8B:
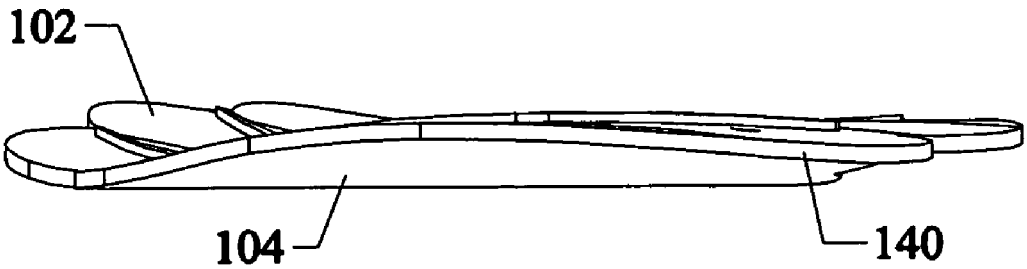

FIG. 8B is a root end side perspective view of the twisted blade of FIG. 7A along arrow 8B.

Figure 9A:
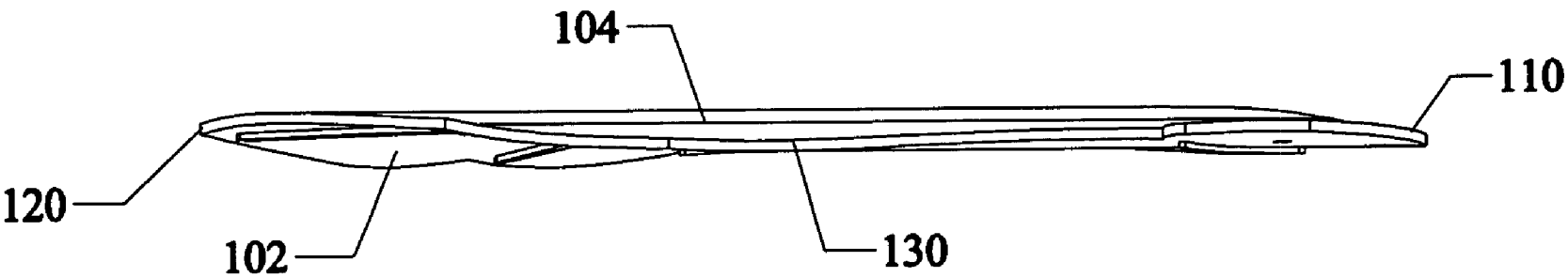

FIG. 9A is a left side perspective view of the twisted blade of FIG. 7A along arrow 9A.

Figure 9B:
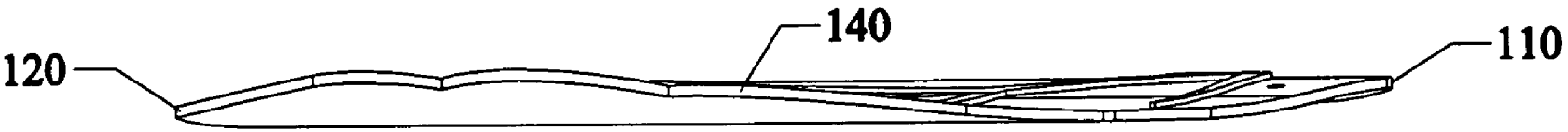

FIG. 9B is a right side perspective view of the twisted blade of FIG. 7A along arrow 9B.

Figure 10A:
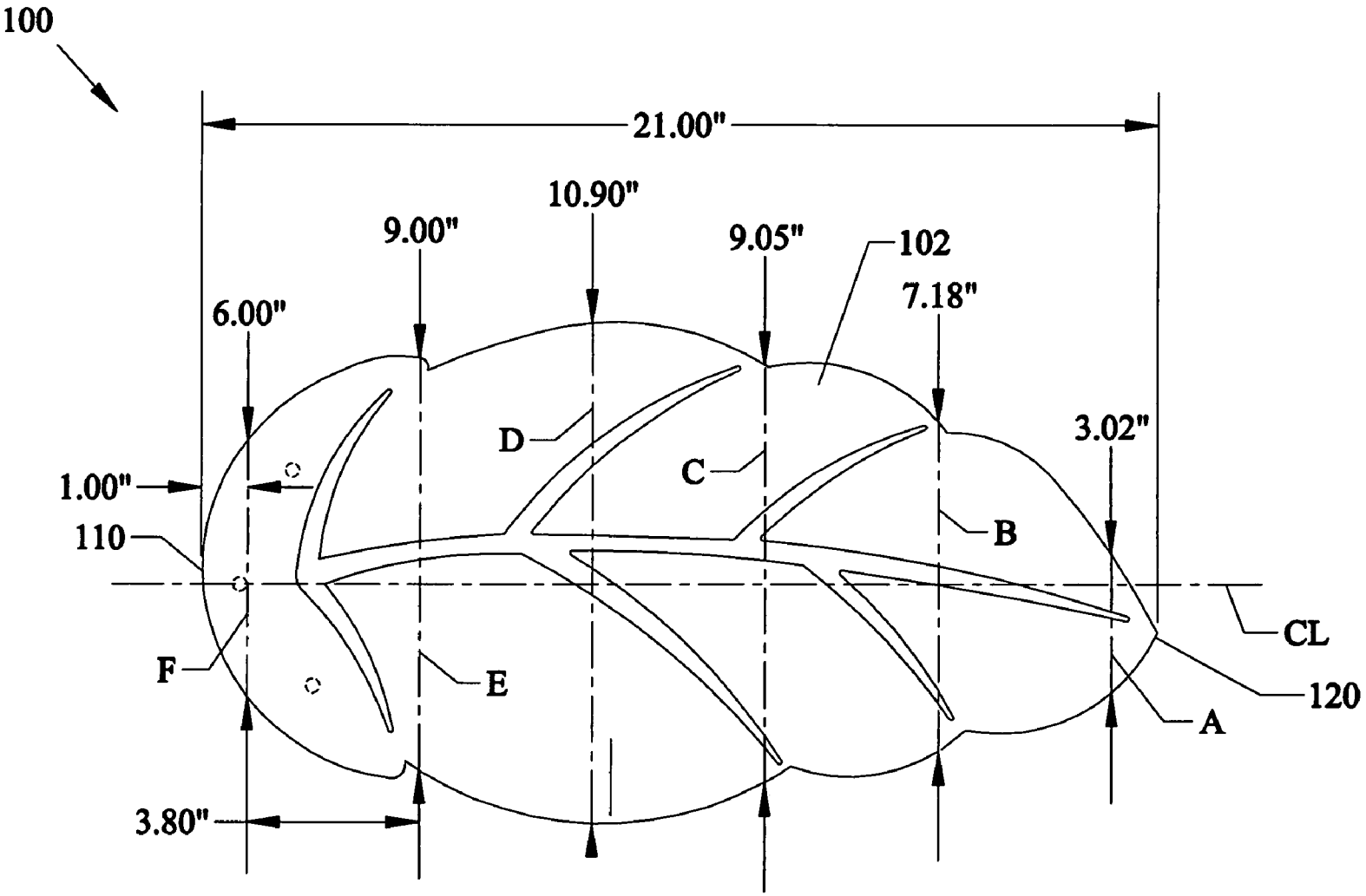

FIG. 10A is another bottom perspective view of the twisted blade of FIG. 7A with labeled cross-sections A, B, C, D, E, F.

Figure 10B:
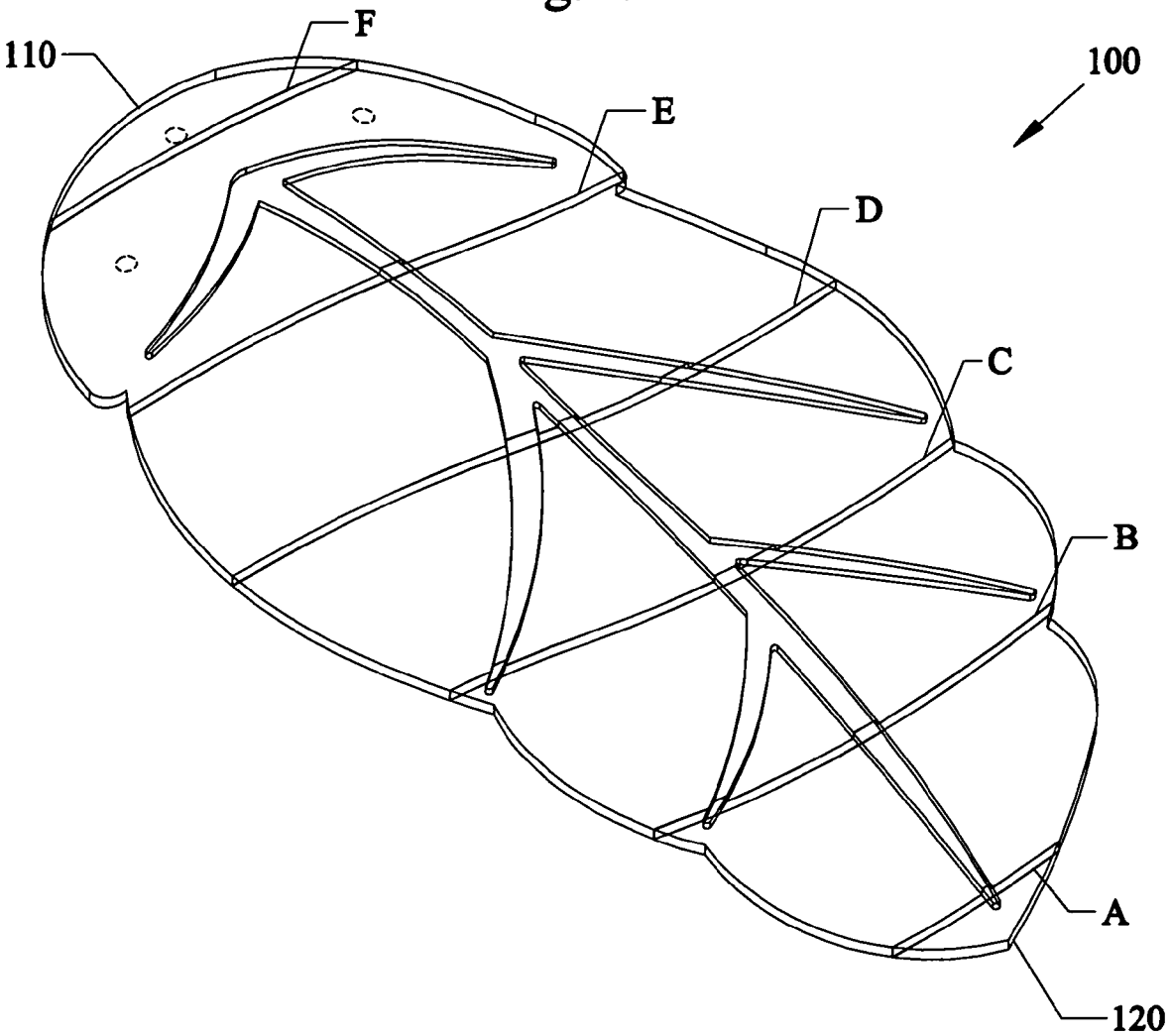

FIG. 10B is another bottom right tip end perspective view of the twisted blade of FIGS. 7A and 10A with labeled cross-sections A, B, C, D, E, F in perspective curve views.

Figure 11:
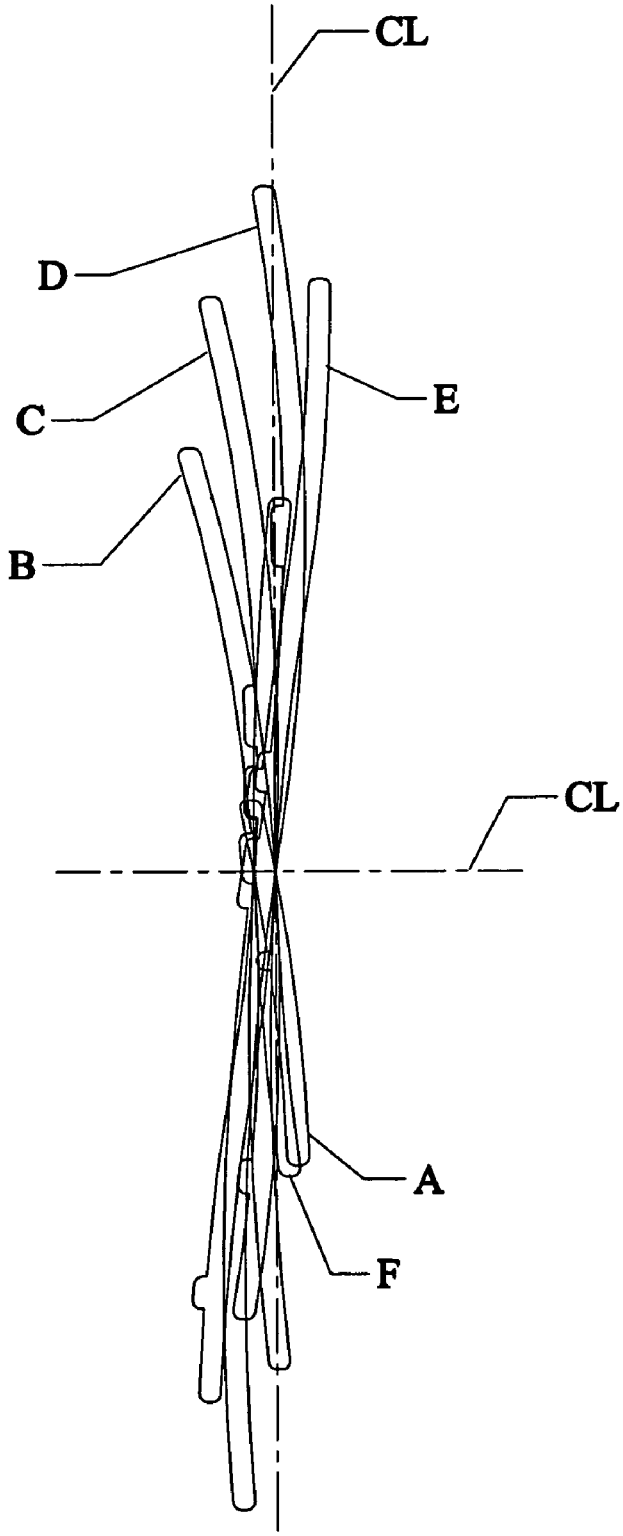

FIG. 11 shows the cross-sections A, B, C, D, E, F of FIGS. 10A, 10B superimposed over one another.

Figure 11C:
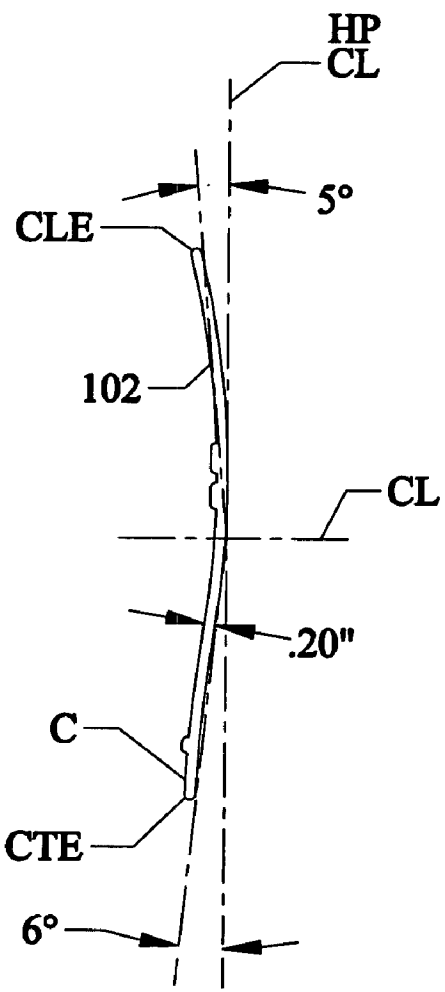
Figure 11B:
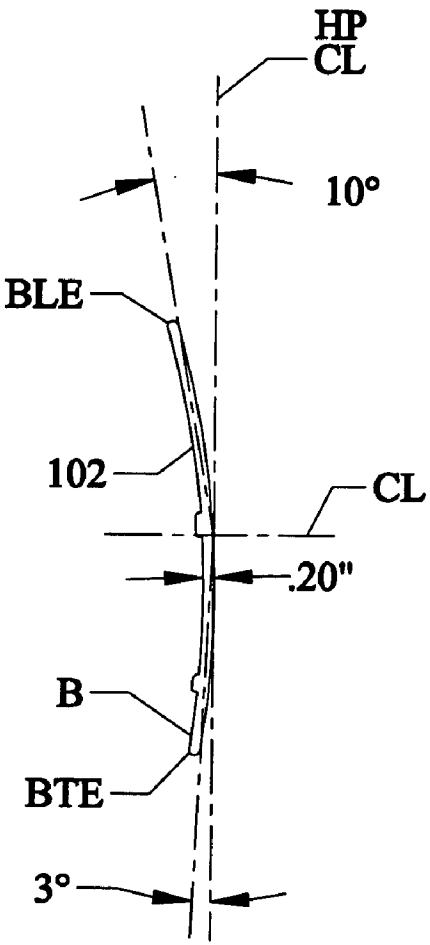
Figure 11A:
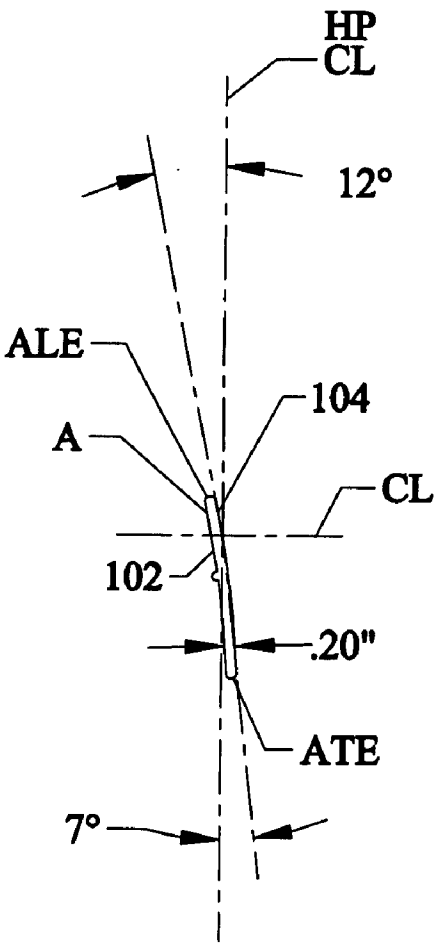

FIG. 11A shows the cross-section A of FIGS. 10A, 10B, 11.

FIG. 11B shows the cross-section B of FIGS. 10A, 10B, 11.

FIG. 11C shows the cross-section C of FIGS. 10A, 10B, 11.

Figure 11F:
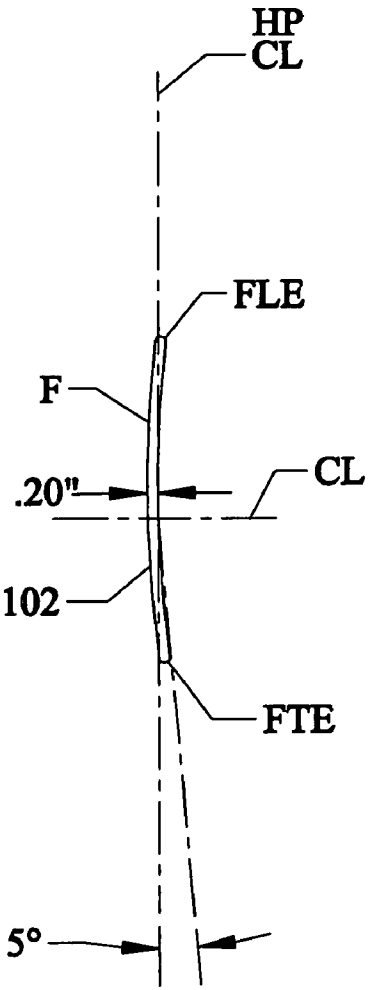
Figure 11E:
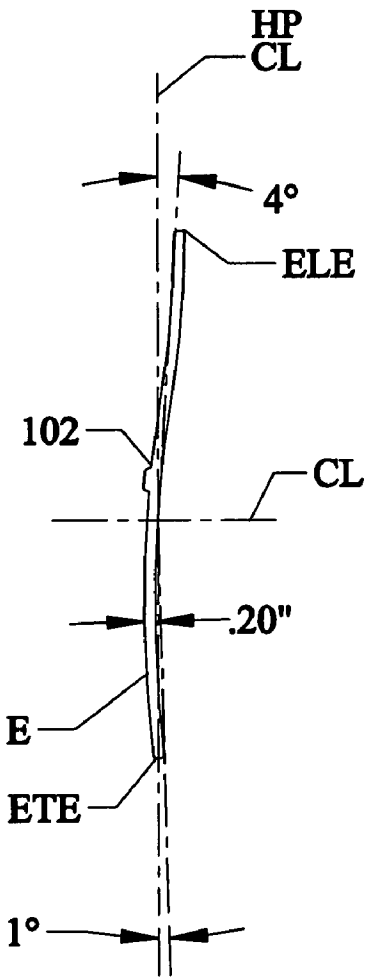
Figure 11D:
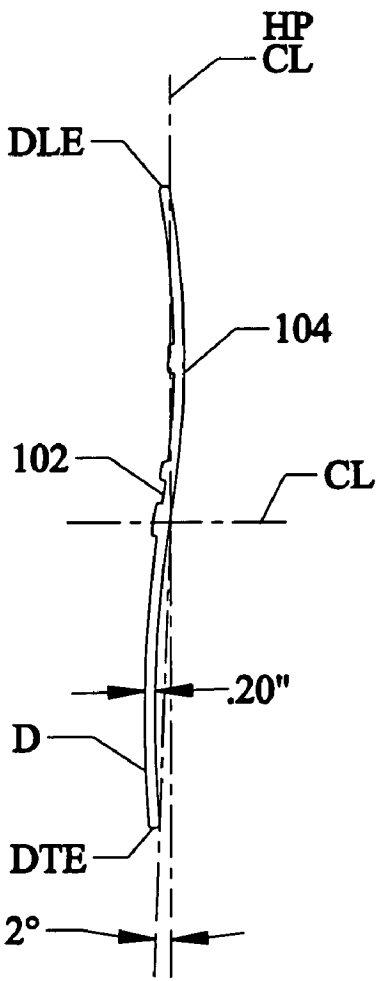

FIG. 11D shows the cross-section D of FIGS. 10A, 10B, 11.

FIG. 11E shows the cross-section E of FIGS. 10A, 10B, 11.

FIG. 11F shows the cross-section F of FIGS. 10A, 10B, 11.

Figure 12A:
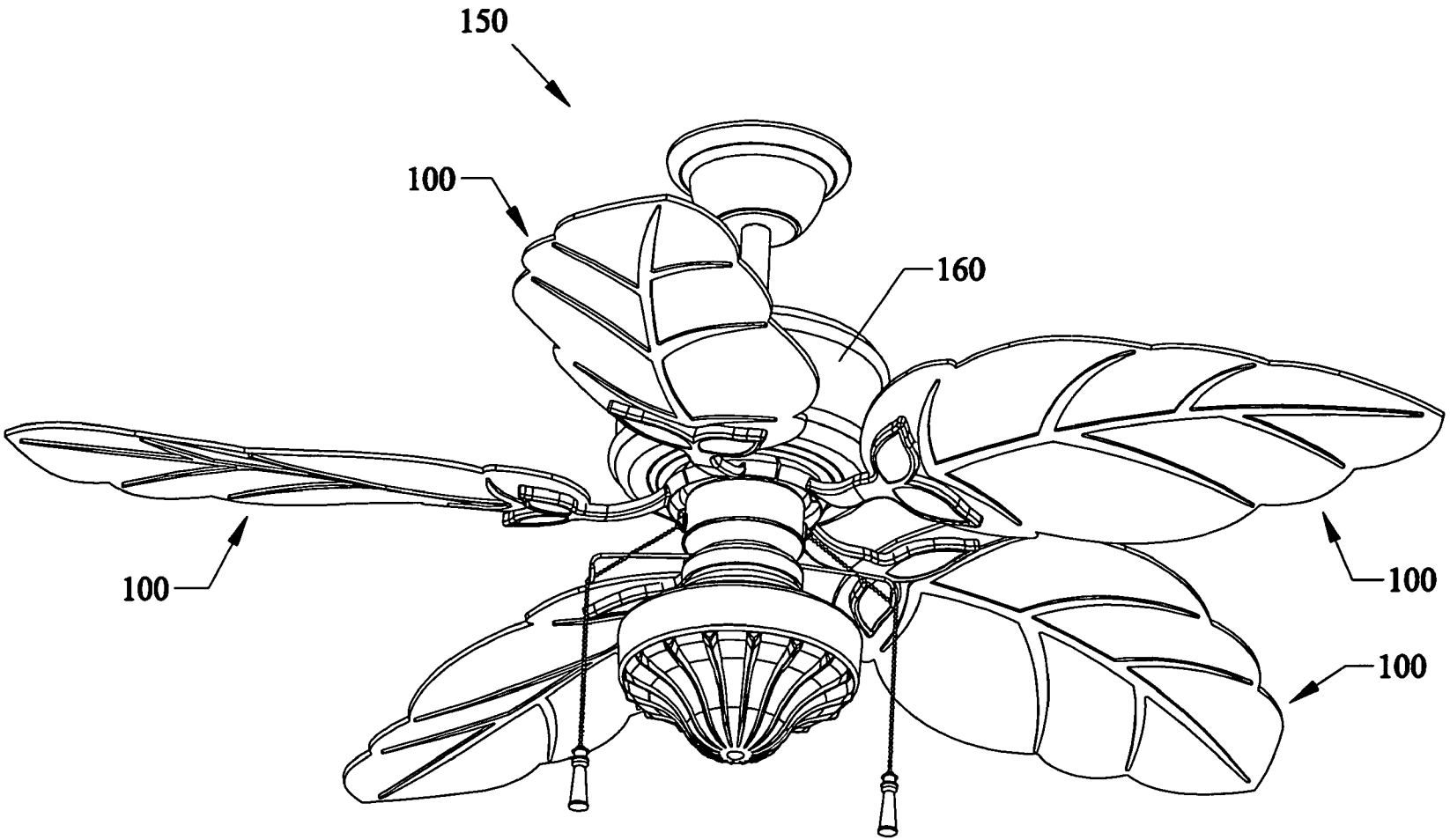

FIG. 12A is a perspective bottom view of a ceiling fan and twisted blades of FIGS. 7-11F FIG. 12B is a perspective top view of the ceiling fan and twisted blades of FIG. 12A.

Figure 12B:
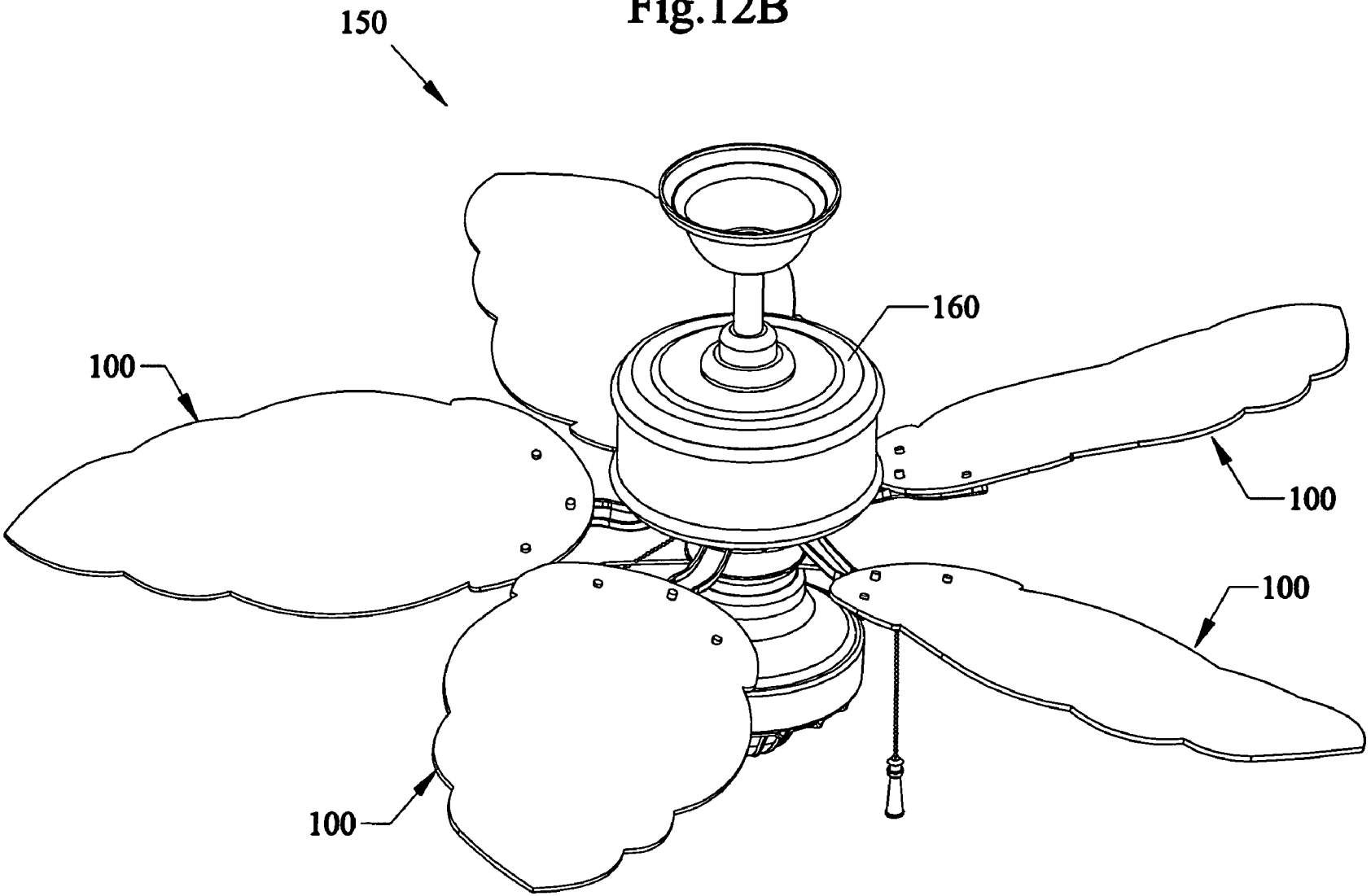
Figure 12C:
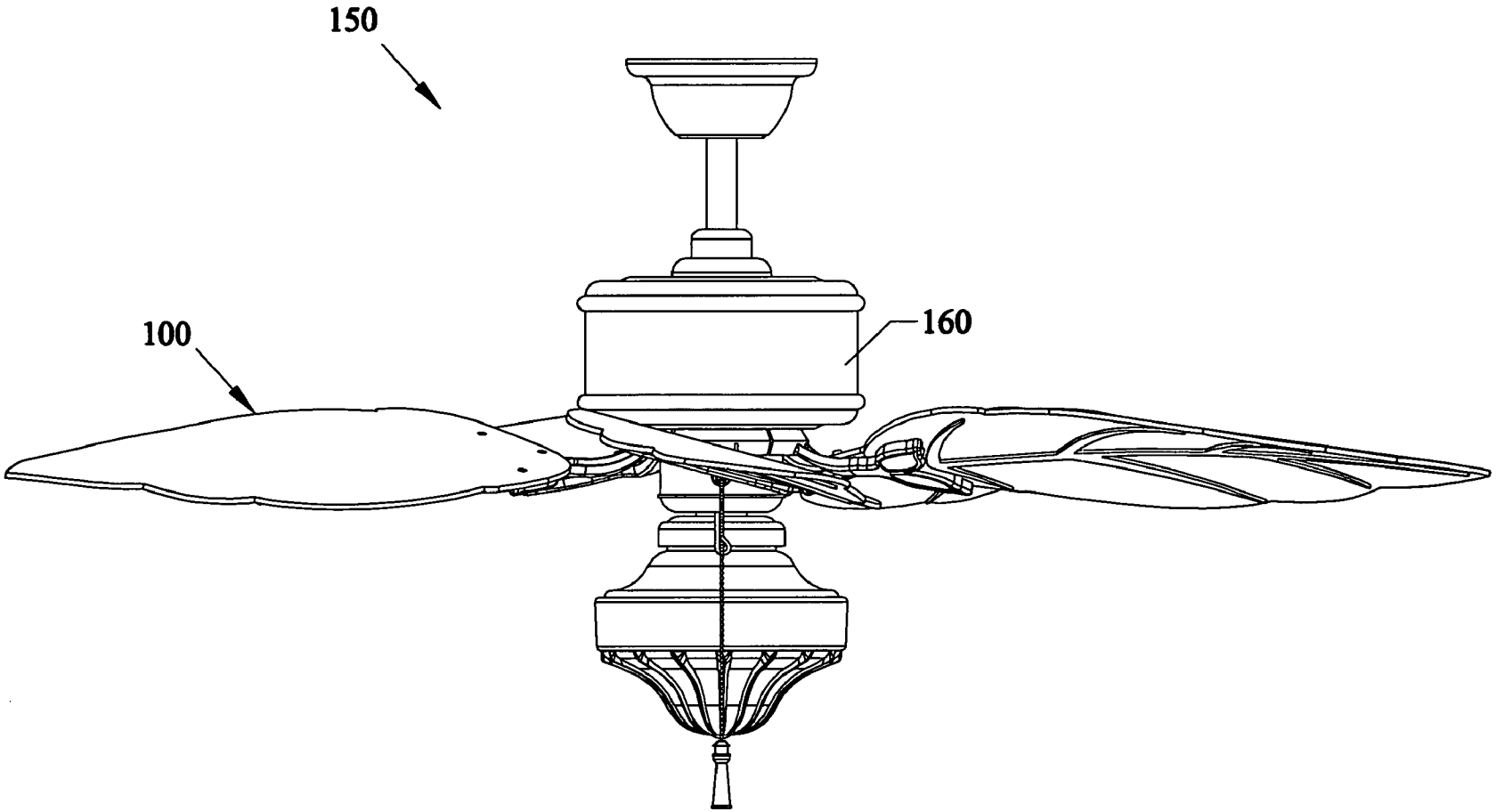

FIG. 12C is a side perspective view of the ceiling fan and twisted blades of FIG. 12A.

Figure 12D:
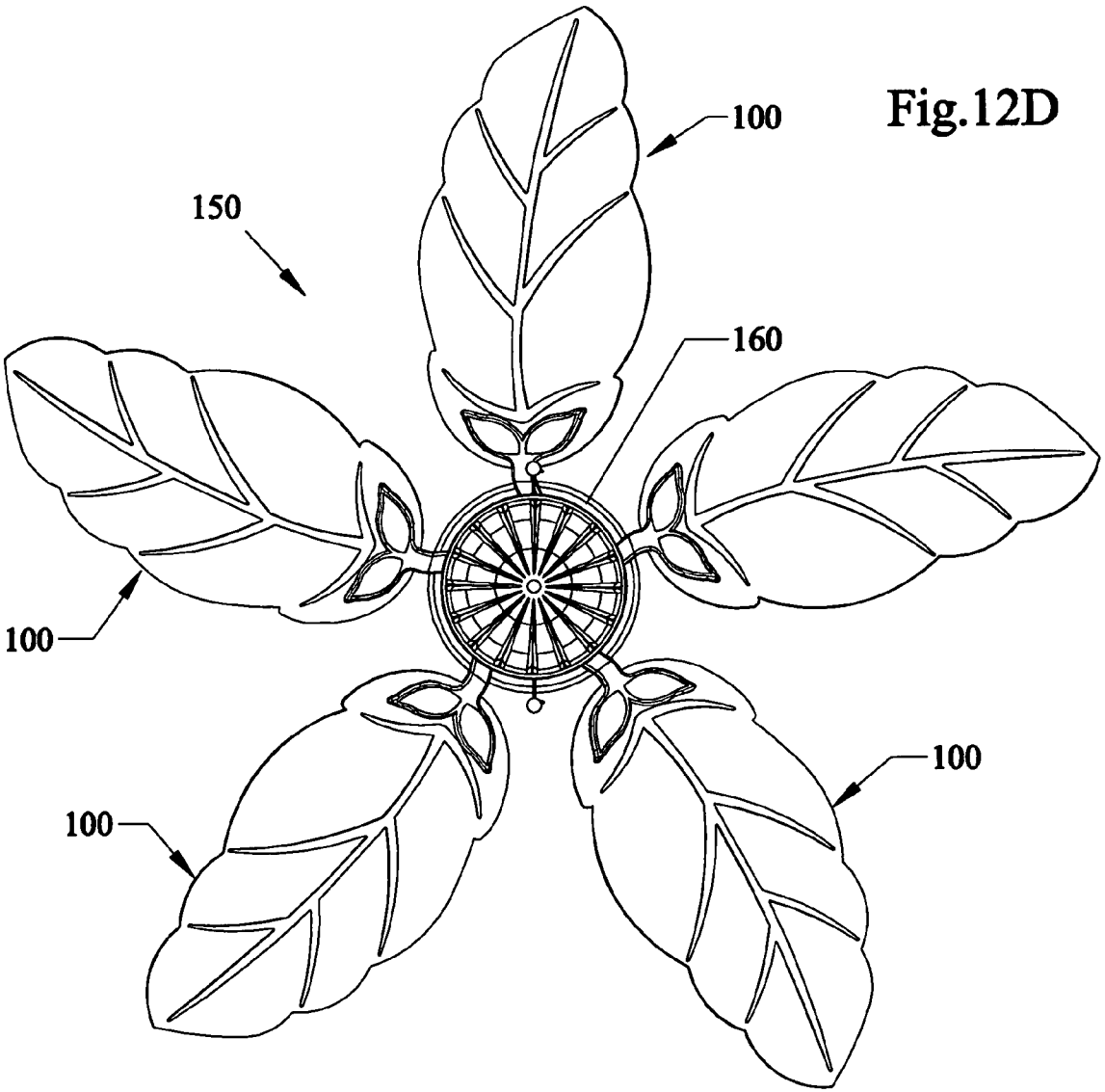

FIG. 12D is a bottom view of the ceiling fan and twisted blades of FIG. 12A.

Figure 12E:
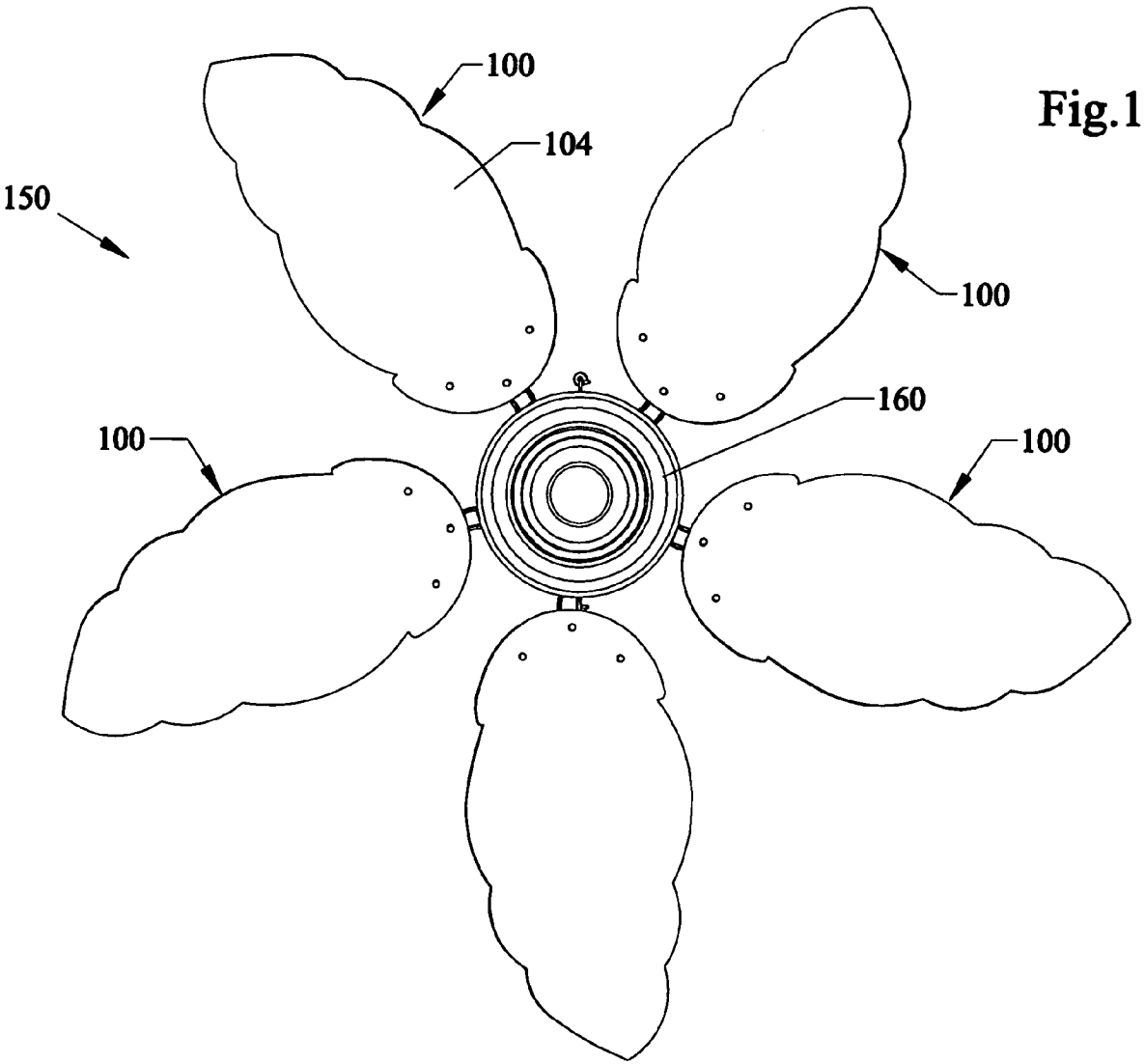

FIG. 12E is a top view of the ceiling fan and twisted blades of FIG. 12A.

DESCRIPTION OF THE PREFERRED EMBODIMENT

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation.

Testing of novel ceiling fan blades were first described in detail to parent patent application to the subject invention, namely U.S. patent Ser. No. 09/056,428 filed Apr. 7, 1998, now U.S. Pat. No. 6,039,541, and incorporated by reference. The initial novel blades were tested between May and June, 1997 at the Florida Solar Energy Center® in Cocoa, Fla., and included three parameters of measurement data: airflow (meters per second (m/s), power (in watts) and speed (revolutions per minute (rpm)). Those novel ceiling fan blades far surpassed the operating parameters of various ceiling fans in operation, as do the subject fan blades of this invention.

This invention is a Continuation-In-Part of application Ser. No. 11/027,242 filed Dec. 31, 2004, which is a divisional application of Ser. No. 10/121,388 filed Apr. 12, 2002 now U.S. Pat. No. 6,884,034 which claims the benefit of priority to Provisional Application 60/342,564 filed Dec. 26, 2001, is a Continuation-In-Part of U.S. application Ser. No. 09/976,515 filed Oct. 12, 2001, now U.S. Pat. No. 6,659,721, which claims the benefit of Provisional Application 60/265,241 filed Jan. 31, 2001, and is a continuation-in-part of U.S. Ser. No. 09/711,599 filed Nov. 13, 2000, now U.S. Pat. No. 6,415,984, which is a divisional application of U.S. Ser. No. 09/415,883 filed Oct. 8, 1999 now U.S. Pat. No. 6,189,799, which is a divisional application of U.S. Ser. No. 09/067,236 filed Apr. 27, 1998 now U.S. Pat. No. 5,996,898 which is incorporated by reference, which is a continuation-in-part of U.S. Ser. No. 09/056,428 filed Apr. 7, 1998 now U.S. Pat. No. 6,039,541 all of which are incorporated by reference.

A prototype of the novel twisted leaf ceiling fan blades were tested in 2005. Existing ceiling fan leaf shaped blades such as those in U.S. Design Pat. D485,345 to Bucher which is incorporated by reference was modified to incorporate camber and twist in the decorative blade profile. A prototype was developed by taking one of the existing blades so that the lightweight wood of each fan blade was cut into five sections with four cuts. The cuts were each glued back together at a set angle. The two cuts closest to the leading edge of the blade were re-glued at an angle of approximately 10 degrees with the underside concave. The third cut was re-glued at a lesser angle of about 6 degrees. The fourth cut was re-glued with a reflex making the topside concave, at an angle of about 10 degrees. Each blade was glued in the same jig, so that all the blades were quite similar in shape. The reflex in the blade airfoil was to improve performance when the fan is running in reverse.

The leading edge of each blade was modified by adding some material to the bottom surface and removing some material from the top surface. This form of camber at the airfoil leading edge was also to improve performance. The blades were balanced with washers to make the static weight moments of all the blades the same. This was done by setting a fulcrum pivot for each blade at the motor shaft location. Weights were added to the blades until all the blade tips weighed the same, when weighed at the same radius.

The modified blade is intended to move more air than the flat paddle blade, with the same input power. The camber and twist allow the blade to work at lower RPM (revolutions per minute). To work effectively at lower RPM the blades can also be set at a higher pitch. The mounting brackets on the modified set of blades have been re-bent to a higher pitch setting.

The motor efficiency was expected to change with RPM. The modified aerodynamic blades were expected to work best in conjunction with a motor that has good efficiency at slower RPM.

To separate the effects of aerodynamics and electrical motor performance a dynamometer set up was used for the testing procedures. A dynamometer measures torque and RPM. A torque sensor can be used where the motor mounts to the ceiling. With no other torques on the motor, the torque on the mount is the same as the torque on the turning shaft. The mechanical power going from the motor to the fan is equal to the torque times the RPM times a constant factor.

In English units the torque in foot-lbs times the rotational speed in radians/second is the power in foot-lbs/second. In metric units the torque in newton-meters times the rotational speed in radians/second equals the power in watts. To convert RPM into radians/second, and rad/sec=2 PI×RPM/60.

Laboratory tests were conducted on a standard ceiling fan with leaf-like blades such as those shown and described in U.S. Design Pat. D485,345 to Bucher which is incorporated by reference against that for the improved "flying leaf" design. The Standard fan was a Hamptom Bay Model Antigua motor having blades with a diameter of approximately 56 inches across five blades, powered by a triple capacitor Powermax 188 mm by 155 mm motor.

The data yielded the following improvements in Table 1 at Low Speed of the existing standard leaf shaped blade having a low speed of approximately 70 RPM (revolutions per minute) and the novel twisted leaf shaped blades having a low speed of approximately 86 RPM.

Table 2 has data of Medium Speed for the existing standard leaf shaped blade having a medium speed of approximately 111 RPM, and the novel twisted leaf shaped blades having a medium speed of approximately 135 RPM.

Table 3 has data of High Speed for the existing standard leaf shaped blade having a high speed of approximately 134 RPM, and the novel twisted leaf shaped blades having a high speed of approximately 164 RPM.

Measurements were taken in an environmental chamber under controlled conditions using solid state measurement methods recommended by the United States Environmental Protection Agency in their Energy Star Ceiling Fan program which used a hot wire anemometer which required a temperature controlled room and a computer for testing data.

http://www.energystar.gov/ia/partners/prod_development/revisions/downloads/ceil_fans/final.pdf In the tables below, air flow in CFM stands for cubic feet per minute, and power is measured in Watts (W).

TABLE 1

Low Speed

| BLADE TYPE | Speed (RPM) | CFM | Power (Watts) | cfm/W |
|---|---|---|---|---|
| Standard Ceiling Fan with Leaf-like blades: | 70 | 2330 | 17.4 | 134 |
| Same Ceiling Fan with Aerodynamic Leaf-like blades: | 86 | 2780 | 17.4 | 160 |

As shown in Table 1 at low speed, absolute flow (CFM) (2780/2330) was increased by approximately 19.3% with efficiency (160/134) improved by a similar amount of approximately 19%.

TABLE 2

Medium Speed

| BLADE TYPE | Speed (RPM) | CFM | Power (Watts) | cfm/W |
|---|---|---|---|---|
| Standard Ceiling Fan with Leaf-like blades: | 111 | 3230 | 39.5 | 82 |
| Same Ceiling Fan with Aerodynamic Leaf-like blades: | 135 | 4840 | 39.1 | 124 |

As shown in Table 2, at medium speed, absolute flow (CFM) (4840/3230) was increased by approximately 50% with efficiency (124/82) improved by approximately 51%.

TABLE 3

High Speed

| BLADE TYPE | Speed (RPM) | CFM | Power (Watts) | cfm/W |
|---|---|---|---|---|
| Standard Ceiling Fan with Leaf-like blades: | 134 | 4060 | 56.7 | 71 |
| Same Ceiling Fan with Aerodynamic Leaf-like blades: | 164 | 6304 | 56.6 | 111 |

As shown in Table 3 at high speed, absolute flow (6304/4060) was increased by approximately 55% with efficiency (111/71) improved by approximately 56%.

Overall efficiency of the twisted leaf shaped aero dynamic blades were approximately 56% more efficiency at high speed than the standard Leaf-like blades.

The United States government has initiated a program entitled: Energy Star (www.energystar.gov) for helping businesses and individuals to protect the environment through superior energy efficiency by reducing energy consumption and which includes rating appliances such as ceiling fans that use less power than conventional fans and produce greater cfm output. As of Oct. 1, 2004, the Environmental Protection Agency (EPA) has been requiring specific air flow efficiency requirements for ceiling fan products to meet the Energy Star requirements which then allow those products to be labeled Energy Star rated. Table 4 below shows the current Energy Star Program requirements for residential ceiling fans with the manufacturer setting their own three basic speeds of Low, Medium and High.

TABLE 4

Air Flow Efficiency Requirements (Energy Star)

| Fan Speed | Mininum Airflow | Efficiency Requirement |
|---|---|---|
| Low | 1,250 CFM | 155 CFM/Watt |
| Medium | 3,000 CFM | 100 CFM/Watt |
| High | 5,000 CFM | 75 CFM/Watt |

Note, that Energy Star program does not require what the speed ranges for RPM are used for low, medium and high, but rather that the flow targets in Table 1 are met:

For Energy Star, residential ceiling fan airflow efficiency on a performance bases is measured as CFM of airflow per watt of power consumed by the motor and controls. This standard treats the motor, blades and controls as a system, and efficiency can be measured on each of three fan speeds (low, medium, high) using standard testing.

From Table 4, it is clear that the aerodynamic twisted leaf shape ceiling fan blades running at all speeds of low, medium and high meet and exceed the Energy Star Rating requirements. The subject invention is believed to be the only leaf shaped blades for use on ceiling fans that have been invented that can meet and exceed the Energy Star ratings.

First Embodiment Twisted Leaf Blades

Figure 1A:
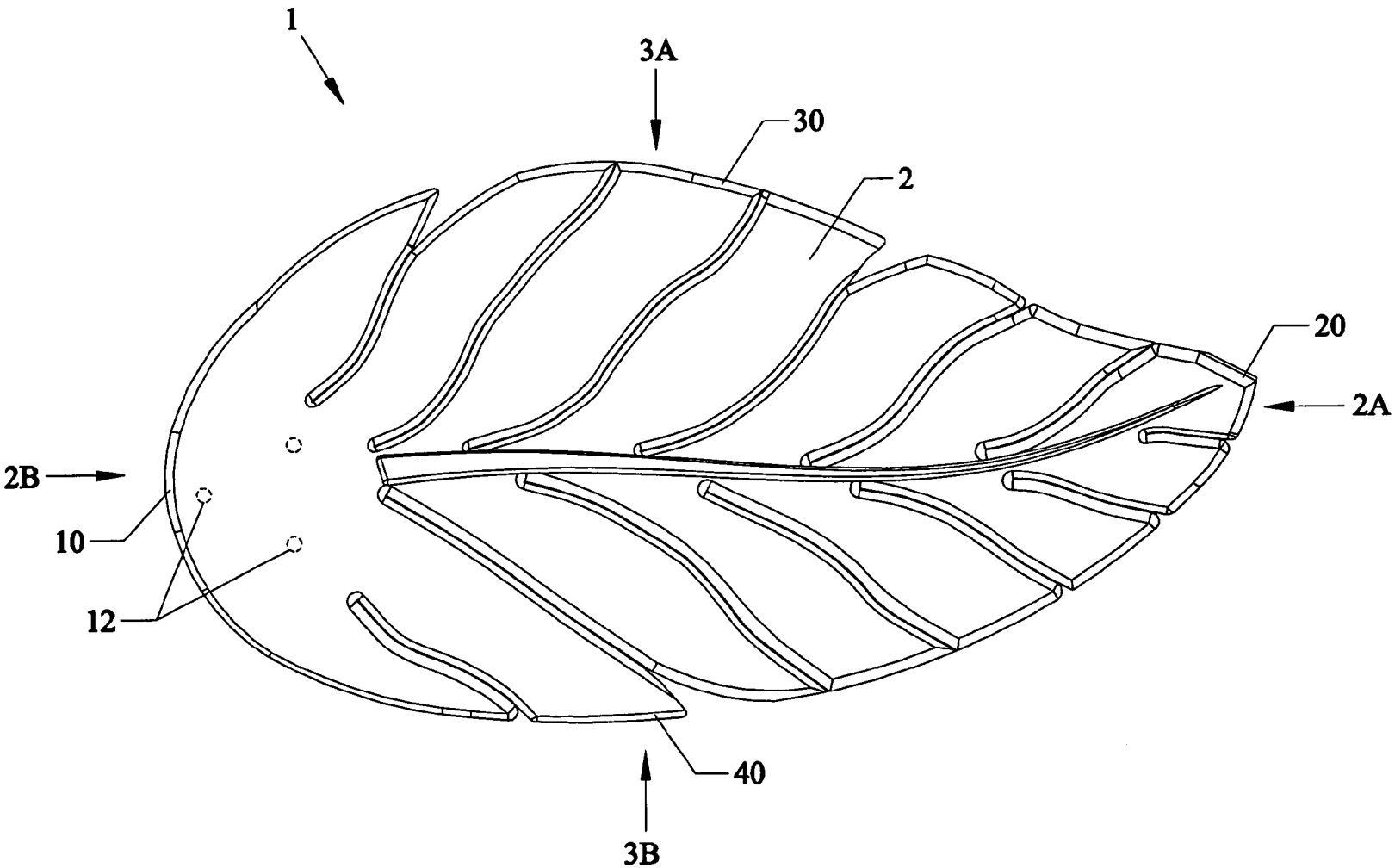
FIG. 1A is a bottom perspective view of a first embodiment twisted leaf ceiling fan blade.
Figure 1B:
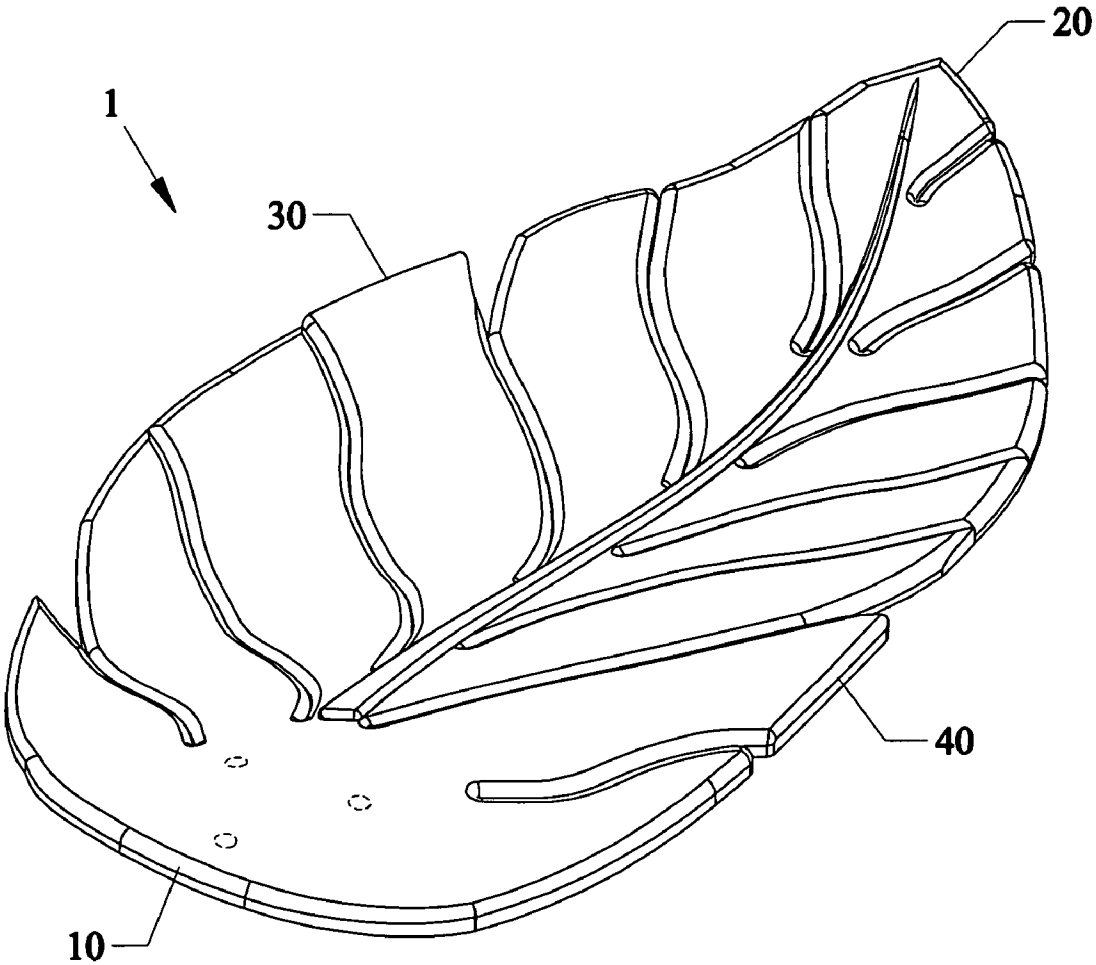
FIG. 1B is a bottom right root end perspective view of the twisted blade of FIG. 1A.
Figure 1C:
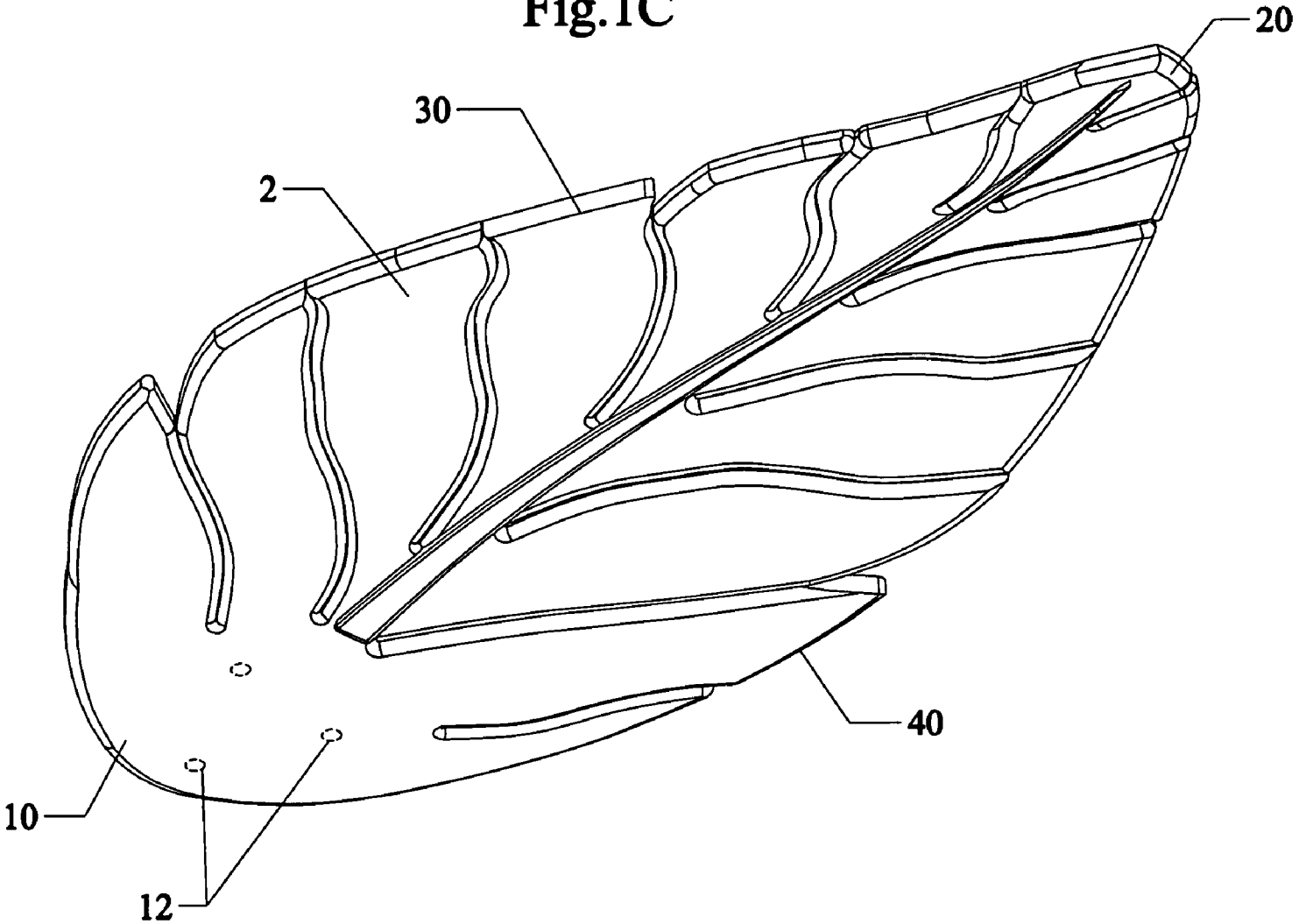
FIG. 1C is a bottom left root end perspective view of the twisted blade of FIG. 1A.
Figure 1D:
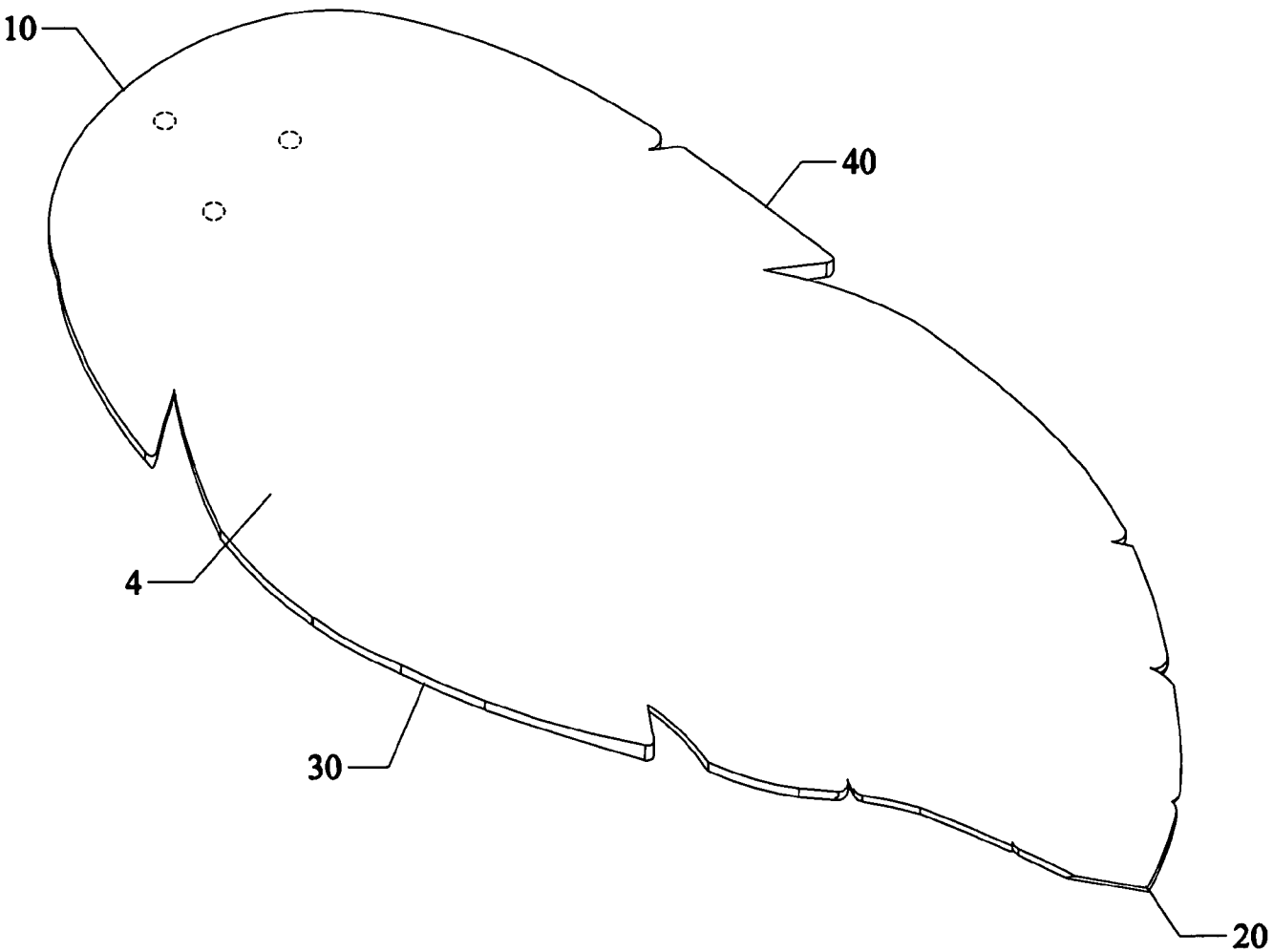
FIG. 1D is a top right tip end perspective view of the twisted blade of FIG. 1A.

FIG. 1A is a bottom perspective view of a first embodiment twisted leaf ceiling fan blade 1 showing root end 10, tip end 20, left side 30 and right side 40. FIG. 1B is a bottom right root end 10 perspective view of the twisted blade 1 of FIG. 1A. FIG. 1C is a bottom left root end 10 perspective view of the twisted blade 1 of FIG. 1A. FIG. 1D is a top 4 right tip end 20 perspective view of the twisted blade 1 of FIG. 1A.

Figure 2A:
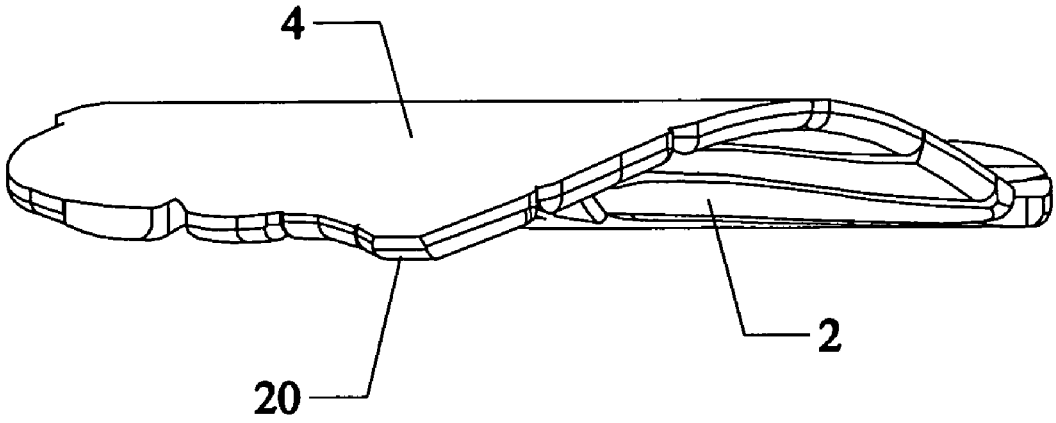
FIG. 2A is a tip end side perspective view of the twisted blade of FIG. 1A along arrow 2A.
Figure 2B:
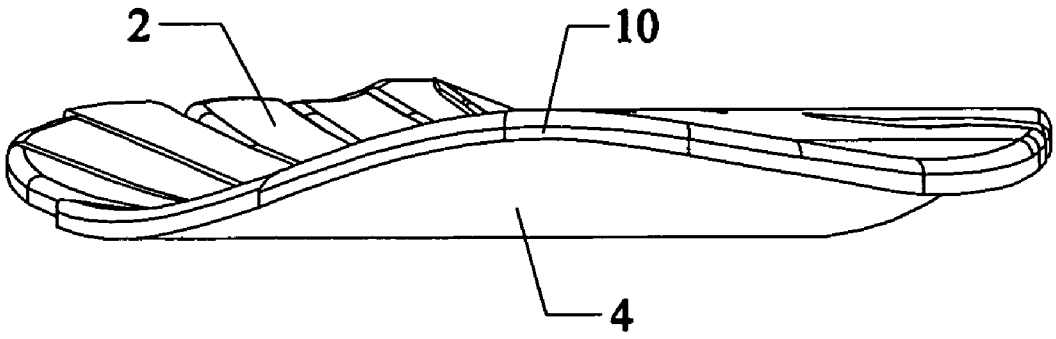
FIG. 2B is a root end side perspective view of the twisted blade of FIG. 1A along arrow 2B.
Figure 3A:
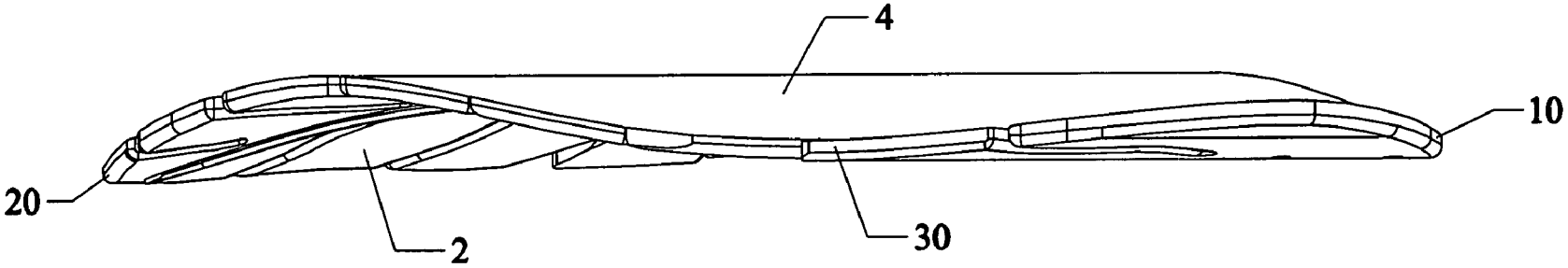
FIG. 3A is a left side perspective view of the twisted blade of FIG. 1A along arrow 3A.
Figure 3B:
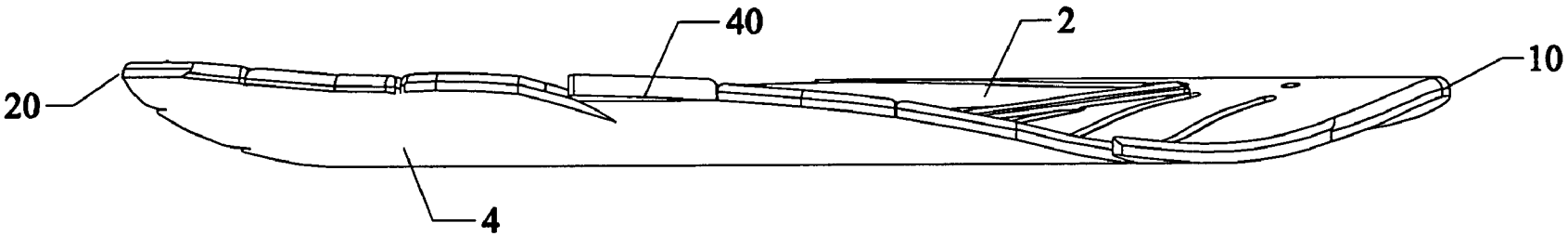
FIG. 3B is a right side perspective view of the twisted blade of FIG. 1A along arrow 3B.

FIG. 2A is a tip end 20 side perspective view of the twisted blade 1 of FIG. 1A along arrow 2A. FIG. 2B is a root end 10 side perspective view of the twisted blade 1 of FIG. 1A along arrow 2B. FIG. 3A is a left side 30 perspective view of the twisted blade 1 of FIG. 1A along arrow 3A. FIG. 3B is a right side 40 perspective view of the twisted blade 1 of FIG. 1A along arrow 3B.

Referring to FIGS. 1A-3B, the bottom view side 2 can have a twisted leaf appearance configuration, with the side edges along right and left sides 30, 40 being angled edges for enhanced airflow. Top side 4 of the twisted leaf blade 1 which faces up toward a ceiling can have a planar smooth surface.

Sides 30, 40 of the blade can have grooved cuts to add to the leaf appearance. Mounting holes 12 such as three being shown can pass through the blade adjacent to the root end 10 for attaching the blade to mounting arms (shown in FIGS. 6A-6E) that are then attached to a ceiling fan motor housing (shown in FIGS. 6A-6E).

Figure 4A:
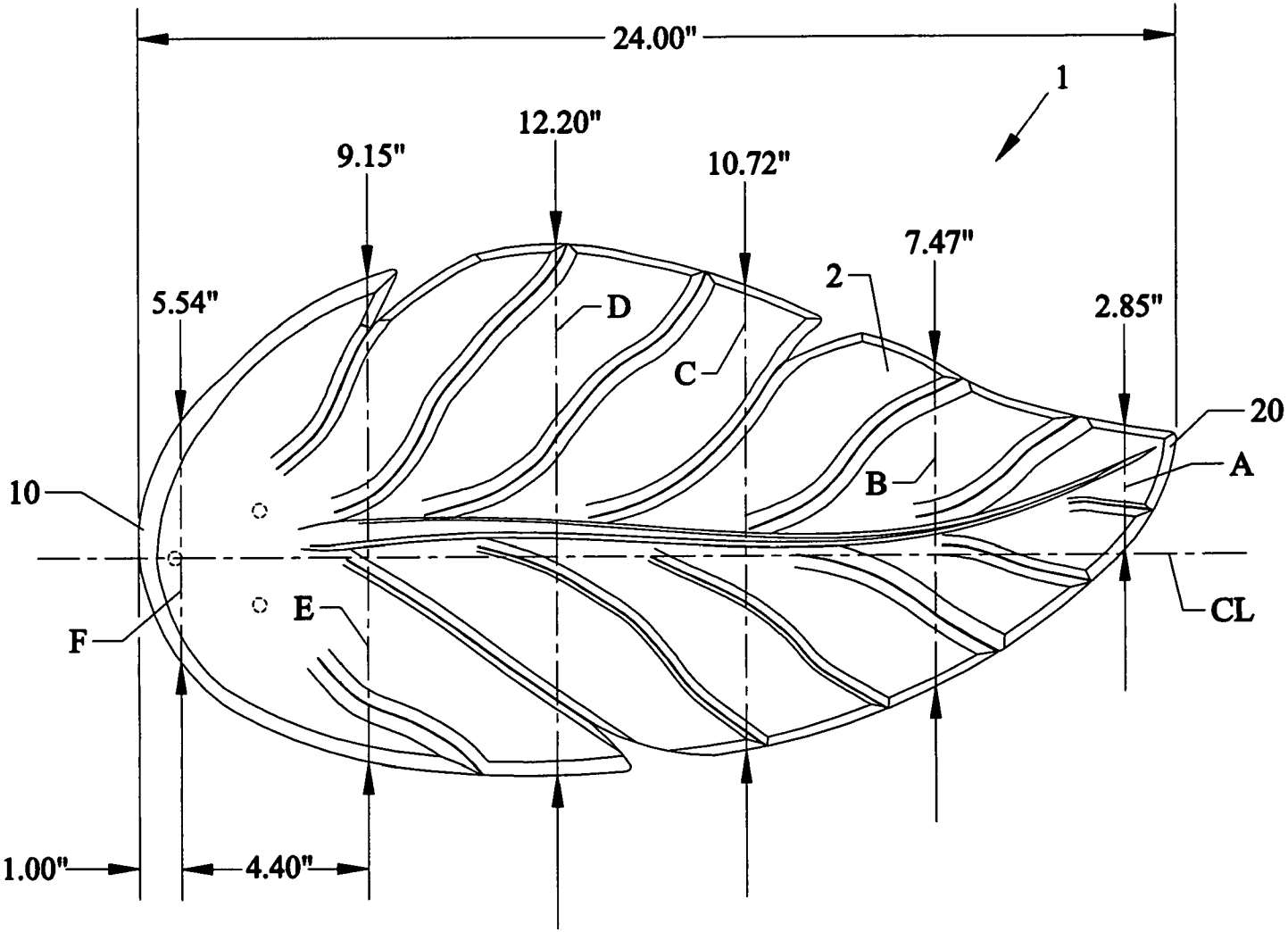
FIG. 4A is another bottom perspective view of the twisted blade of FIG. 1A with labeled cross-sections A, B, C, D, E, F.

FIG. 4A is another bottom perspective view of the twisted blade 1 of the preceding figures. The twisted blade 1 has an overall length between root end 10 and 20 being approximately 24" long and 0.35" thick with labeled cross-sections A having a width of approximately 2.85", B having a width of approximately 7.47", C having a width of approximately 10.72", D having a width of approximately 12.20", E having a width of approximately 9.15", and F having a width of approximately 5.54". Each of the cross-sections A-F being approximately 4.4" apart from one another with cross-section A approximately 1" in from root end 10.

Figure 4B:
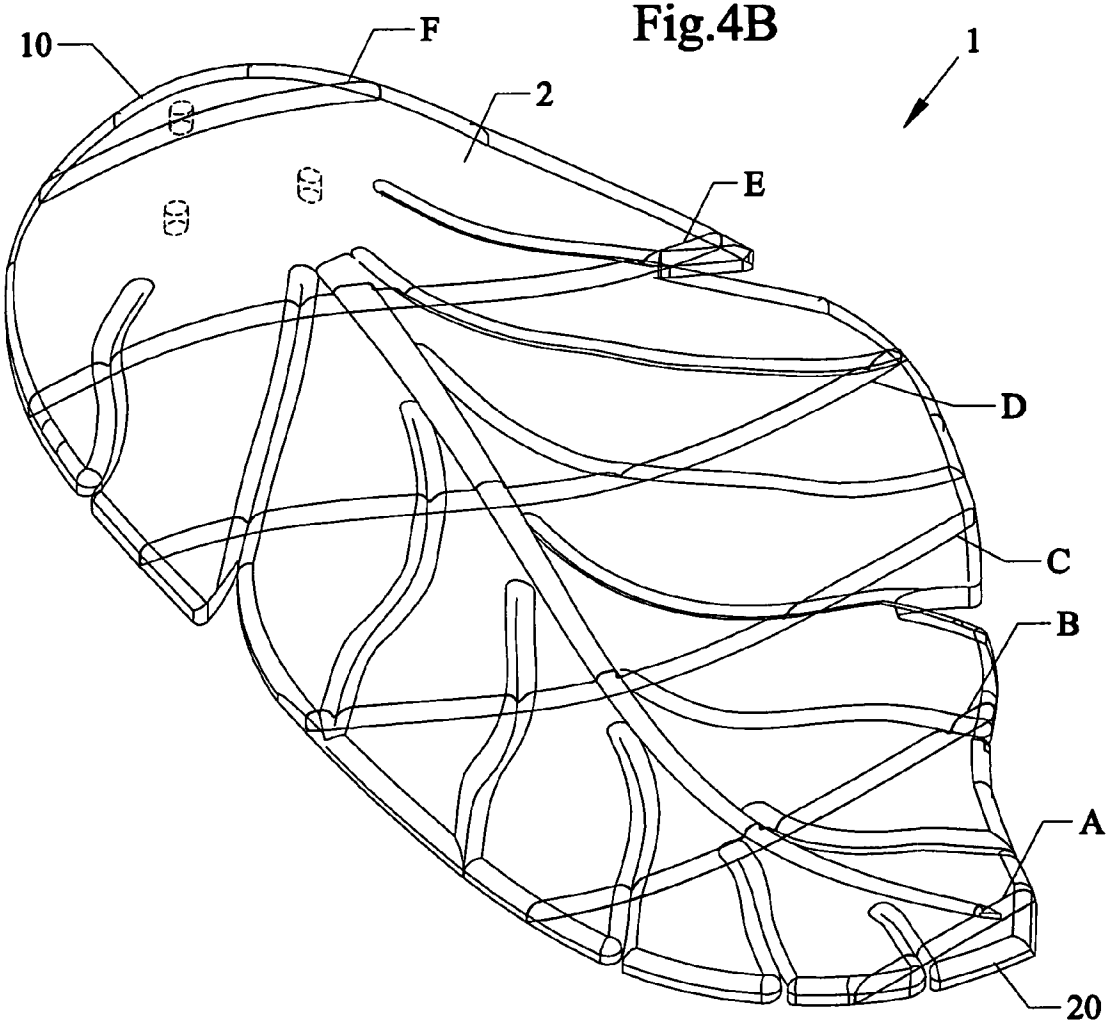
FIG. 4B is another bottom right tip end perspective view of the twisted blade of FIG. 1A and 4A with labeled cross-sections A, B, C, D, E, F in perspective curve views.

FIG. 4B is another bottom 2 right tip end 20 perspective view of the twisted blade 1 of FIG. 1A and 4A with labeled cross-sections A, B, C, D, E, F showing perspective curve views.

Figure 5:
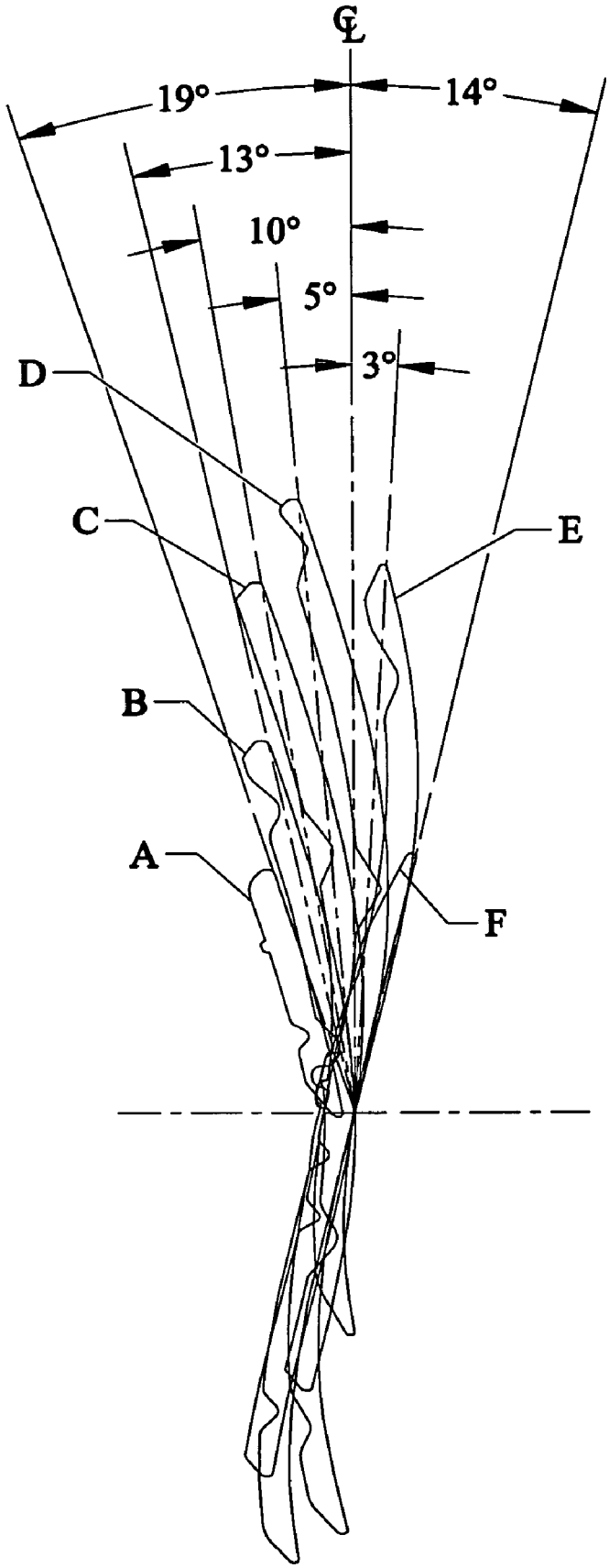
FIG. 5 shows the cross-sections A, B, C, D, E, F of FIGS. 4A, 4B superimposed over one another.

FIG. 5 shows the cross-sections A, B, C, D, E, F of FIGS. 4A, 4B superimposed over one another across a center-line (CL).

Figures 5A, 5B, 5C:
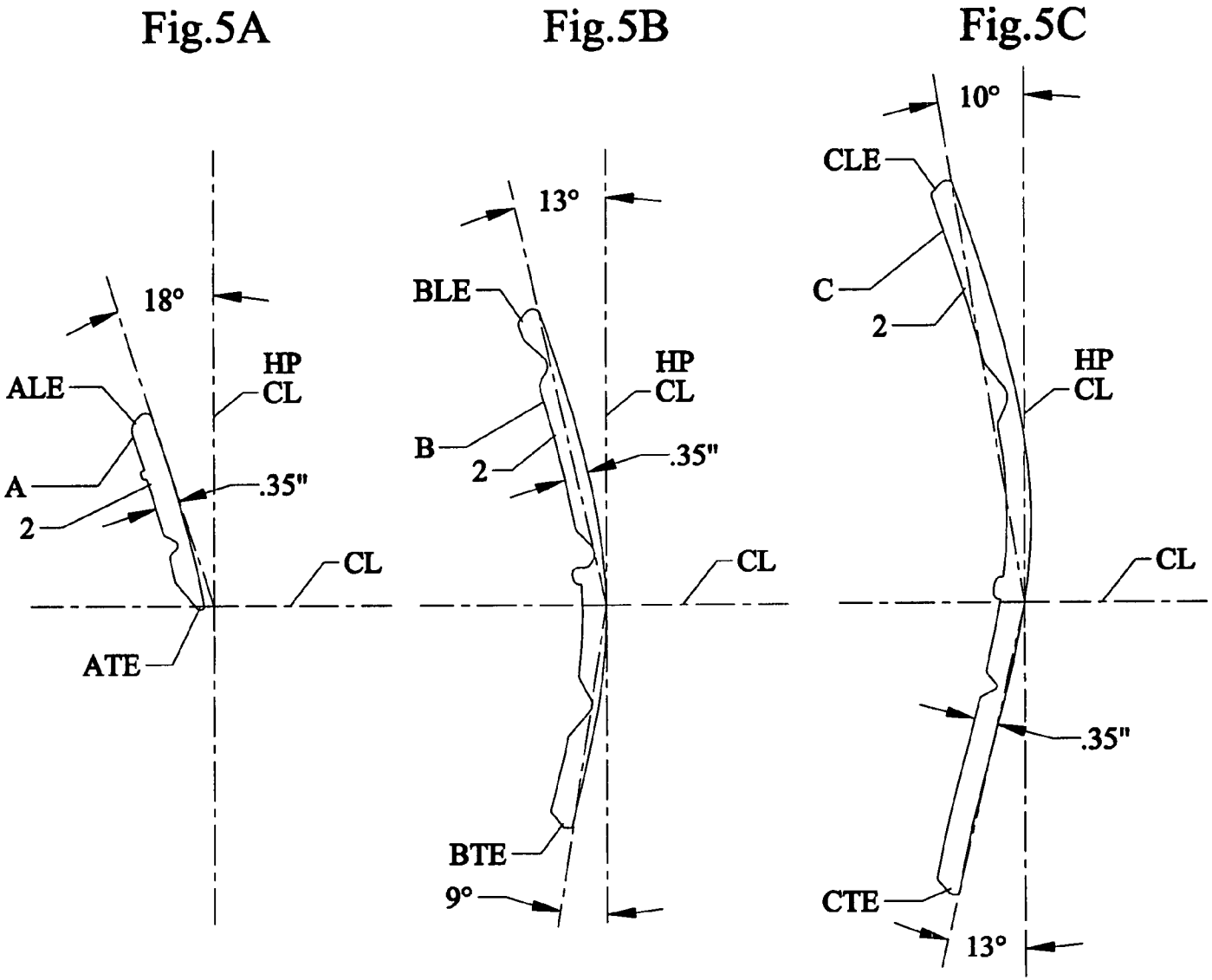
FIG. 5A shows the cross-section A of FIGS. 4A, 4B, 5.
FIG. 5B shows the cross-section B of FIGS. 4A, 4B, 5.
FIG. 5C shows the cross-section C of FIGS. 4A, 4B, 5.

FIG. 5A shows the cross-section A of FIGS. 4A, 4B, 5, having the leading edge ALE approximately 18 degrees below the horizontal plane HP and the trailing edge ATE adjacent to the horizontal plane HP. As can be seen the bottom surface 2 can have a leaf contoured surface with the top surface 4 being planar, and the leading edge ALE having a more blunt rounded edge than the trailing edge ATE.

FIG. 5B shows the cross-section B of FIGS. 4A, 4B, 5 having a leading edge BLE slightly curved down approximately 13 degrees bend down below the horizontal plane HP. Cross-section B has the contoured leaf surface 2 with a concave bend configuration, and trailing edge BTE approximately 9 degrees below horizontal plane HP.

FIG. 5C shows the cross-section C of FIGS. 4A, 4B, 5 having a leading edge CLE being approximately 10 degrees bent down from the horizontal plane HP. Cross-section C has a contoured leaf surface 2 with a concave bend, and a trailing edge CTE approximately 13 degrees below horizontal plane HP.

Figures 5D, 5E, 5F:
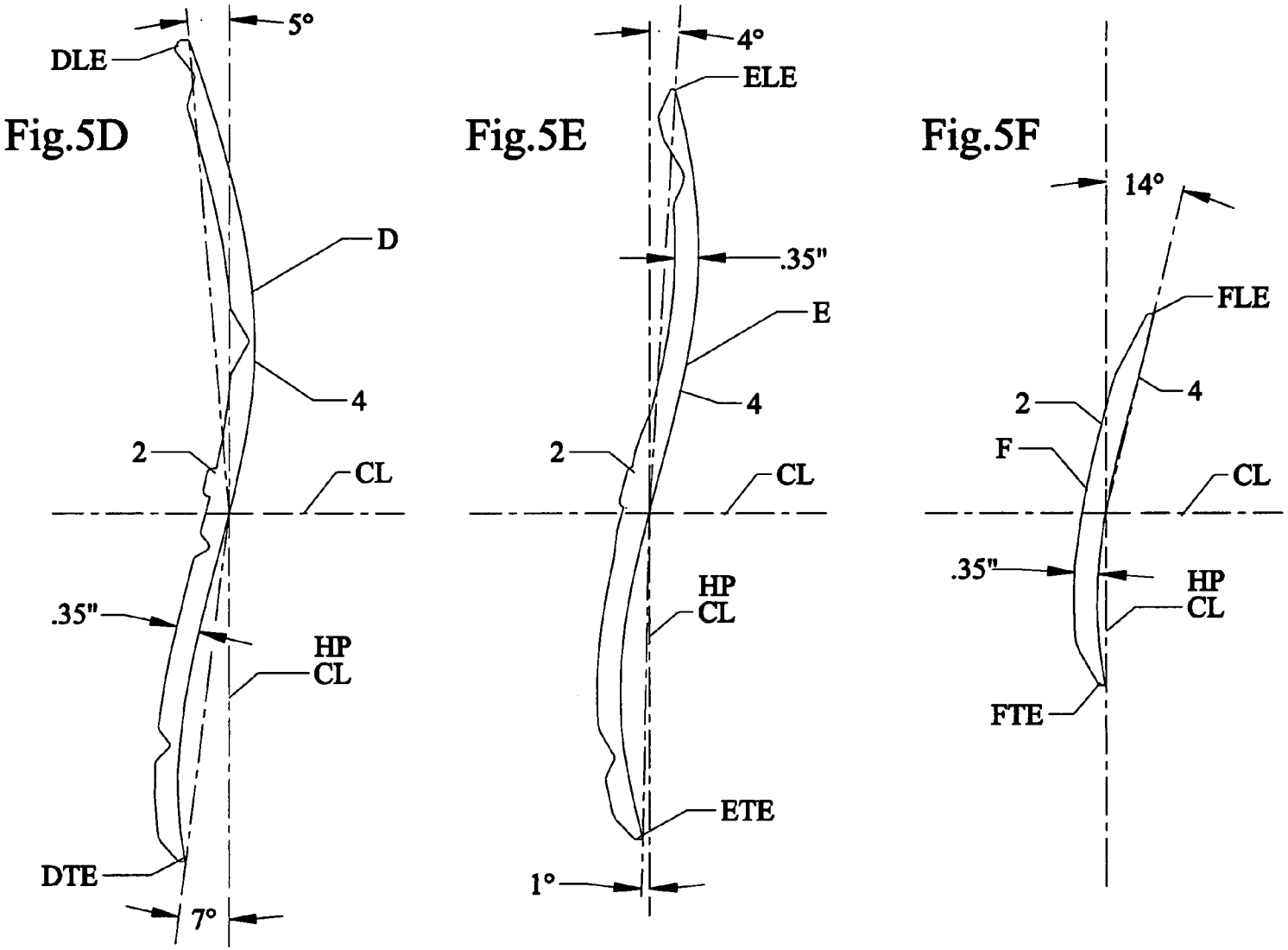
FIG. 5D shows the cross-section D of FIGS. 4A, 4B, 5.
FIG. 5E shows the cross-section E of FIGS. 4A, 4B, 5.
FIG. 5F shows the cross-section F of FIGS. 4A, 4B, 5.

FIG. 5D shows the cross-section D of FIGS. 4A, 4B, 5 having a leading edge DLE having a slight concave bend on bottom surface 2, and a convex bend closer to trailing edge DTE. Cross-section D approaches a slight overall S curve shape with the leading edge DLE being approximately 5 degrees below the horizontal plane HP. The trailing edge DTE being approximately 7 degrees below horizontal plane HP.

FIG. 5E shows the cross-section E of FIGS. 4A, 4B, 5 having a leading edge ELE having a concave bend on bottom surface 2, and a convex bend closer to trailing edge ETE. Cross-section E has a more pronounced overall S curve shape with the leading edge ELE being approximately 4 degrees above the horizontal plane HP. The trailing edge ETE being approximately 1 degree below horizontal plane HP.

FIG. 5F shows the cross-section F of FIGS. 4A, 4B, 5 having an overall convex bottom surface 2 with the leading edge FLE approximately 14 degrees above the horizontal plane.

Figure 6A:
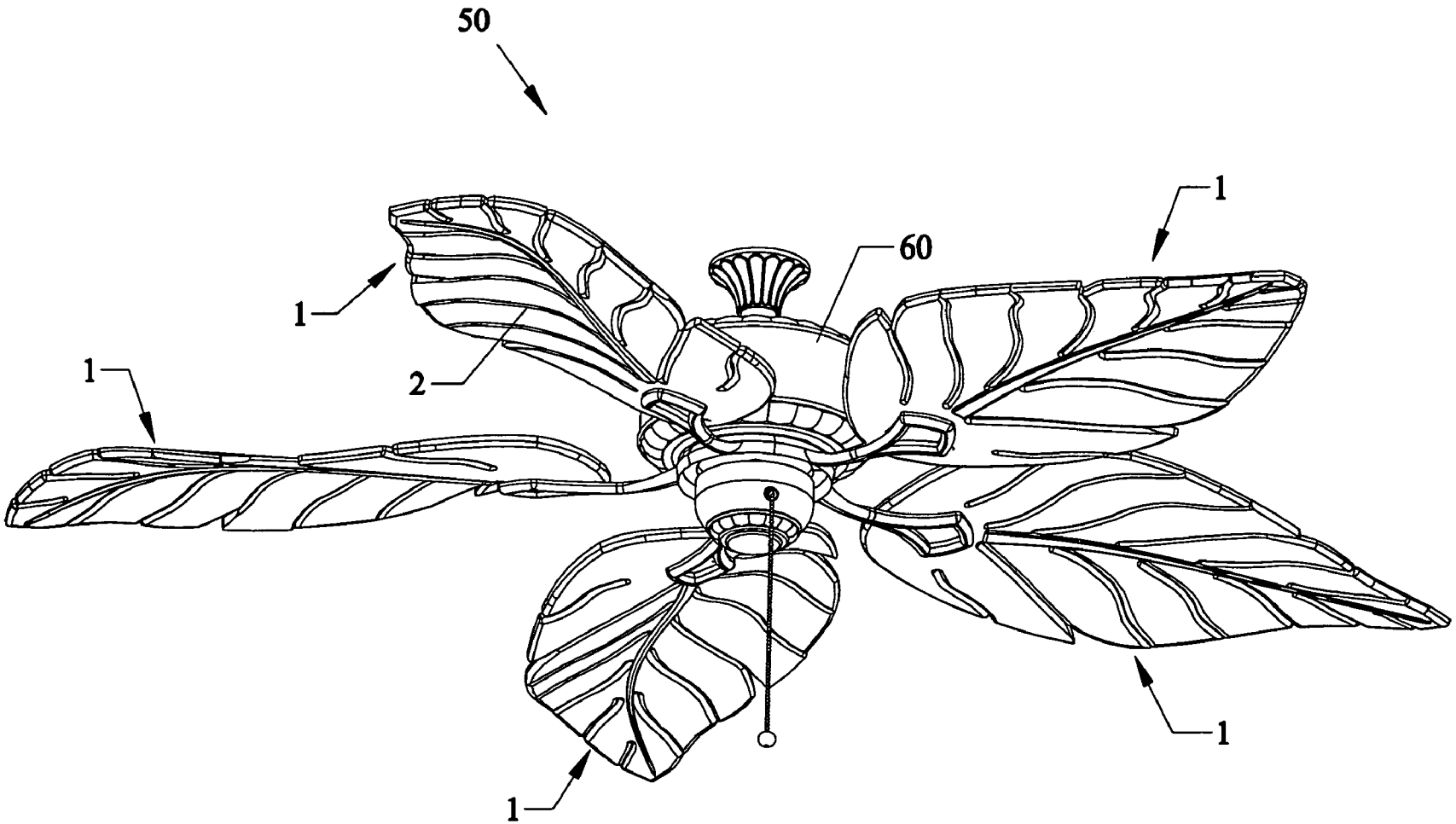
FIG. 6A is a perspective bottom view of a ceiling fan and twisted blades of FIGS. 1A-5F
Figure 6B:
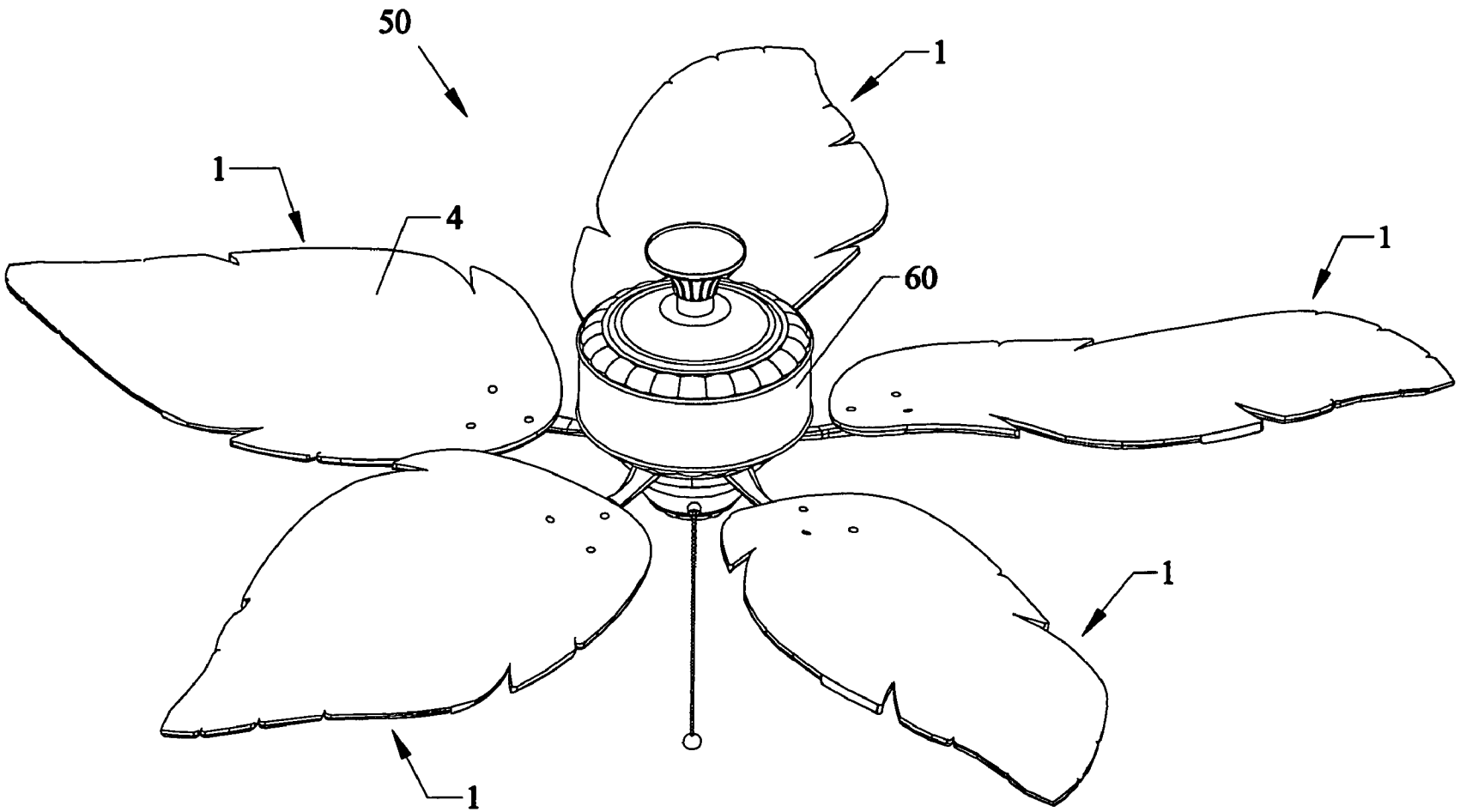
FIG. 6B is a perspective top view of the ceiling fan and twisted blades of FIG. 6A.
Figure 6C:
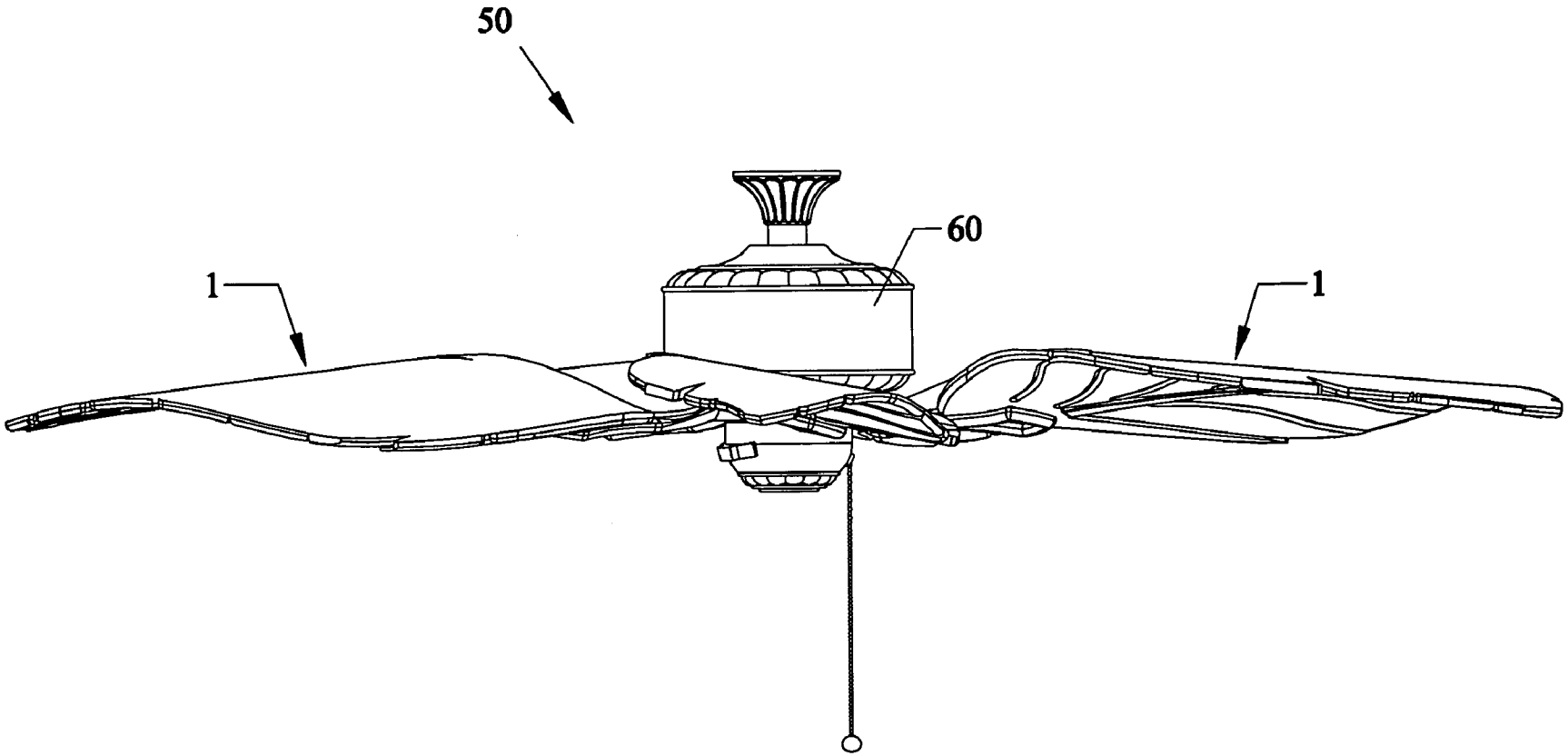
FIG. 6C is a side perspective view of the ceiling fan and twisted blades of FIG. 6A.
Figure 6D:
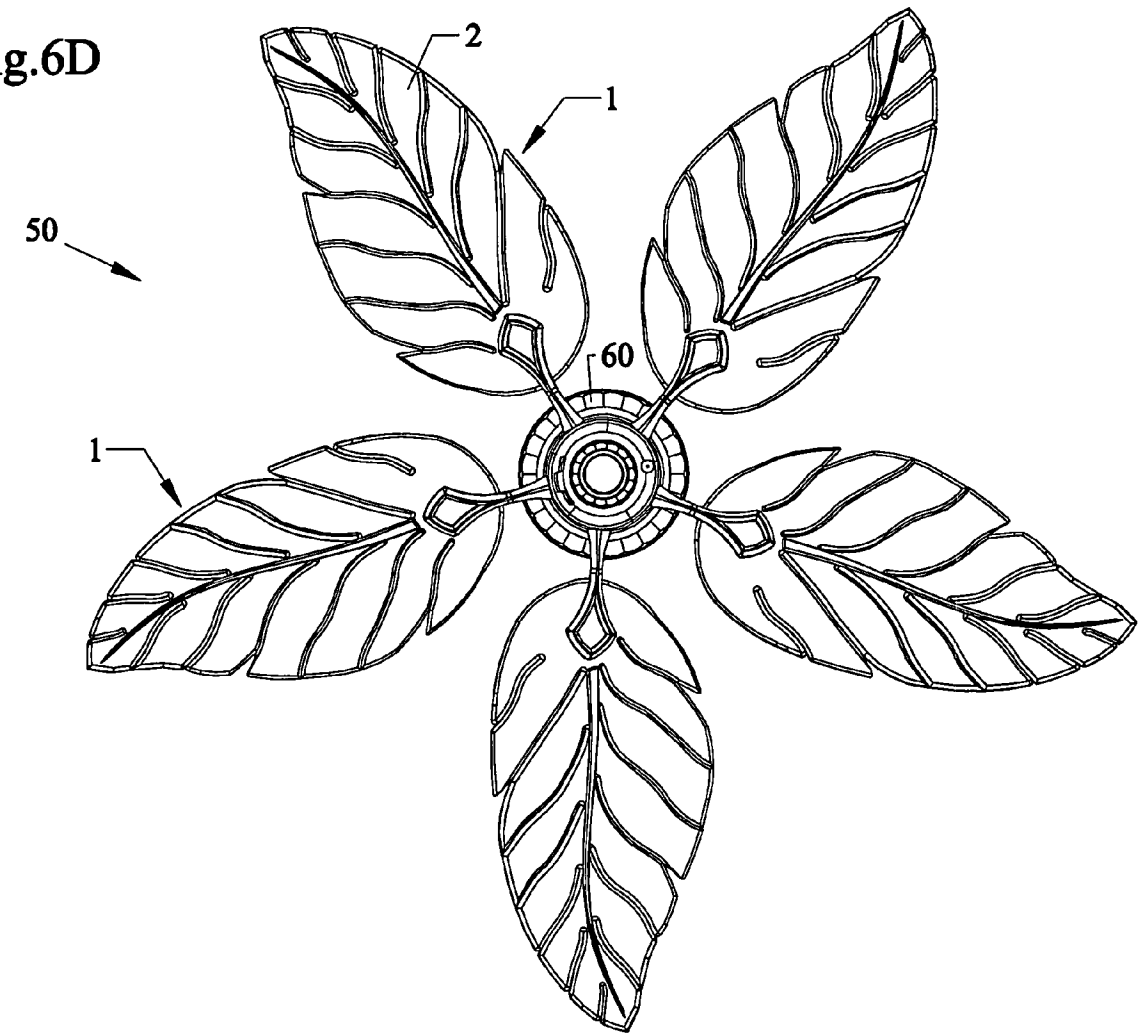
FIG. 6D is a bottom view of the ceiling fan and twisted blades of FIG. 6A.
Figure 6E:
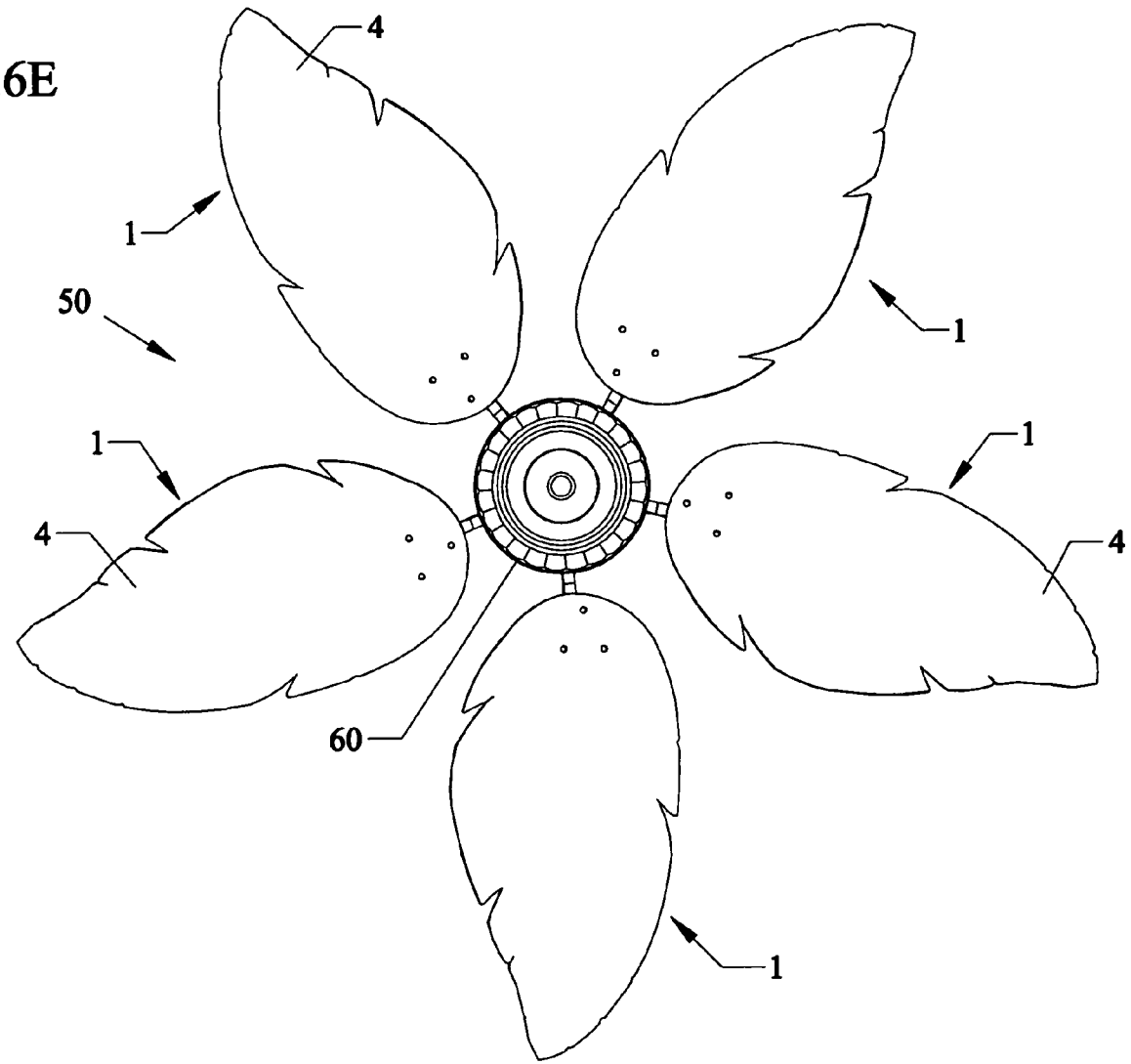
FIG. 6E is a top view of the ceiling fan and twisted blades of FIG. 6A.

FIG. 6A is a perspective bottom view of a ceiling fan 50 and twisted blades 1 of FIGS. 1A-5F attached to a ceiling fan motor 60. FIG. 6B is a perspective top view of the ceiling fan 50 and twisted blades 1 of FIG. 6A. FIG. 6C is a side perspective view of the ceiling fan 50 and twisted blades 1 of FIG. 6A. FIG. 6D is a bottom view of the ceiling fan 50 and twisted blades 1 of FIG. 6A. FIG. 6E is a top view of the ceiling fan 50 and twisted blades 1 of FIG. 6A. Here, a preferred embodiment can use five (5) twisted leaf shaped blades 1.

Other embodiments can use as few as two, three, four, and even six twisted leaf shaped blades. The blades can be formed from carved wood and/or injection molded plastic. The ceiling fan blades can have various diameters such as but not limited to approximately 42", 46", 48", 52", 54", 56", 60" and even greater or less as needed.

Second Embodiment Twisted Leaf Blades

FIG. 7A is a bottom 102 perspective view of a second embodiment twisted leaf ceiling fan blade 100 showing root end 110, tip end 120, left side 130 and right side 140. FIG. 7B is a bottom right root end 110 perspective view of the twisted blade 100 of FIG. 7A. FIG. 7C is a bottom left root end 110 perspective view of the twisted blade 100 of FIG. 7A. FIG. 7D is a top 104 right tip end 120 perspective view of the twisted blade 100 of FIG. 7A.

FIG. 8A is a tip end 120 side perspective view of the twisted blade 100 of FIG. 7A along arrow 8A. FIG. 8B is a root end 140 side perspective view of the twisted blade 100 of FIG. 7A along arrow 8B.

FIG. 9A is a left side 130 perspective view of the twisted blade 100 of FIG. 7A along arrow 9A. FIG. 9B is a right side 140 perspective view of the twisted blade 100 of FIG. 7A along arrow 9B.

FIG. 10A is another bottom perspective view of the twisted blade 100 of FIG. 7A with labeled cross-sections A, B, C, D, E, F.

The twisted blade 100 has an overall length between root end 110 and 120 being approximately 21" long and 0.20" thick with labeled cross-sections A having a width of approximately 3.02", B having a width of approximately 7.18", C having a width of approximately 9.05", D having a width of approximately 10.90", E having a width of approximately 9.00", and F having a width of approximately 6.00". Each of the cross-sections A-F being approximately 3.80" apart from one another with cross-section A approximately 1" in from root end 110.

FIG. 10B is another bottom right tip end 120 perspective view of the twisted blade 100 of FIG. 7A and 10A with labeled cross-sections A, B, C, D, E, F in perspective curve views.

FIG. 11 shows the cross-sections A, B, C, D, E, F of FIGS. 10A, 10B superimposed over one another.

FIG. 11A shows the cross-section A of FIGS. 10A, 10B, 11 having the leading edge ALE approximately 12 degrees below the horizontal plane HP. As can be seen the bottom surface 102 can have a leaf contoured surface with the top surface 104 being planar, and the leading edge ATE having a more blunt rounded edge than the trailing edge ATE. The trailing edge ATE being approximately 7 degrees above the horizontal plane HP.

FIG. 11B shows the cross-section B of FIGS. 10A, 10B, 11 having a leading edge BLE approximately 10 degrees bend down below the horizontal plane HP. Cross-section B has the contoured leaf surface 102 with a concave bend configuration, and trailing edge BTE approximately 3 degrees below horizontal plane HP.

FIG. 11C shows the cross-section C of FIGS. 10A, 10B, 11 having a leading edge CLE bent being approximately 5 degrees bent down from the horizontal plane HP. Cross-section C has a contoured leaf surface 102 with a concave bend, and trailing edge CTE approximately 6 degrees below horizontal plane HP.

FIG. 11D shows the cross-section D of FIGS. 10A, 10B, 11 having a leading edge DLE concave bend closer to the horizontal plane HP. Cross-section D approaches a slight overall S curve shape with the trailing edge DTE being approximately 2 degrees below horizontal plane HP.

FIG. 11E shows the cross-section E of FIGS. 10A, 10B, 11 having a leading edge ELE having a concave bend on bottom surface 102, and a convex bend closer to trailing edge ETE. Cross-section E has a more pronounced overall S curve shape with the leading edge ELE being approximately 4 degrees above the horizontal plane HP. The trailing edge ETE being approximately 1 degree below horizontal plane HP.

FIG. 11F shows the cross-section F of FIGS. 10A, 10B, 11 having an overall convex bottom surface 102 with the trailing edge FTE approximately 5 degrees above the horizontal plane.

FIG. 12A is a perspective bottom view of a ceiling fan 150 and twisted blades 100 of FIGS. 7-11F attached to a ceiling fan motor 160. FIG. 12B is a perspective top view of the ceiling fan 150 and twisted blades 100 FIG. 12A. FIG. 12C is a side perspective view of the ceiling fan 150 and twisted blades 100 of FIG. 12A. FIG. 12D is a bottom view of the ceiling fan 150 and twisted blades 100 of FIG. 12A. FIG. 12E is a top view of the ceiling fan 150 and twisted blades 100 of FIG. 12A.

The preferred embodiments can be used with blades that rotate clockwise or counter-clockwise, where the blades can be positioned to maximize airflow in either rotational directions.

While the preferred embodiment includes providing optimized twisted blades, the invention can be practiced with other aerodynamically shaped leaf shaped blades that can achieve enhanced airflow and efficiency results.

The blade mounting arms can also be optimized in shape to allow the blades to optimize pitch for optimal airflow with or without the aerodynamic leaf shaped blades.

Although the preferred embodiments show leaf shaped configurations on the bottom of the blades 1, 100, the blades can also have leaf shaped configurations on their top surface. Additionally, either or both the preferred embodiments can be made from wood and/or plastic, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A high efficiency ceiling fan comprising:

a hub with a motor; and a plurality of twisted leaf shaped blades attached to the ceiling fan motor, each blade having a twist between a root end, a first midportion, a second midportion, a third midportion, a fourth midportion and a tip end;

the tip end having a width between approximately 2.85" to approximately 3.02" with a leading edge between approximately 18" to approximately 12" below the horizontal plane, and a trailing edge between the horizontal plane and approximately 7 degrees above the horizontal plane;

the first midportion having a width between approximately 7.47" to approximately 7.18" with a leading edge between approximately 13 degrees to approximately 10 degrees below the horizontal plane, and a trailing edge up to approximately 3 degrees below the horizontal plane;

the second midportion having a width of approximately 10.72" to approximately 9.05" with a leading edge between approximately 10 degrees to approximately 5 degrees below the horizontal plane, and a trailing edge between approximately 13 degrees to approximately 6 degrees below the horizontal plane;

the third midportion having a width between approximately 12.20" to approximately 10.90" with a leading edge up to approximately 5 degrees below the horizontal plane, and a trailing edge between approximately 7 degrees to approximately 2 degrees below the horizontal plane;

the fourth midportion having width between approximately 9.15" to approximately 9.00" with a leading edge between approximately 4 degrees above the horizontal plane, and a trailing edge approximately 1 degree below the horizontal plane;

the root end having a width between approximately 5.54" to approximately 6.00" with a leading edge between approximately 14 degrees to approximately 5 degrees above the horizontal plane, wherein the twisted leaf shaped blades move greater amounts of air compared to planar shaped blades.

2. The ceiling fan of claim 1, wherein a diameter across tip ends of blades is: approximately forty eight (48) inches.

3. The ceiling fan of claim 1, wherein a diameter across tip ends of blades is: approximately fifty two (52) inches.

4. The ceiling fan of claim 1, wherein a diameter across tip ends of blades is: approximately fifty four (54) inches.

5. The ceiling fan of claim 1, wherein a diameter across tip ends of blades is: approximately sixty (60) inches.

6. The ceiling fan of claim 1, wherein a diameter across tip ends of blades is: approximately sixty four (64) inches.

7. The ceiling fan of claim 1, wherein each of the blades is formed from molded plastic.

8. The ceiling fan of claim 1, wherein each of the blades is formed from carved wood.

9. A method of operating a ceiling fan, comprising the steps of:

providing twisted leaf shaped blades attached to a ceiling fan motor;

rotating the twisted leaf shaped blades relative to the motor;

generating an airflow of at least approximately 1,250 cfm (cubic feet per minute) below the rotating blades; and running the ceiling fan with the twisted leaf shaped blades with the motor at an efficiency of at least approximately 155 CFM per watt.

10. The method of claim 9, further comprising the step of: rotating the blades up to approximately 250 RPM.

11. A method of operating a ceiling fan, comprising the steps of:

providing twisted leaf shaped blades attached to a ceiling fan motor;

rotating the twisted leaf shaped blades relative to the motor;

generating an airflow of at least approximately 3,000 cfm (cubic feet per minute) below the rotating blades; and running the ceiling fan with the twisted leaf shaped blades with the motor at an efficiency of at least approximately 100 CFM per watt.

12. The method of claim 11, further comprising the step of: rotating the blades up to approximately 250 RPM.

13. A method of operating a ceiling fan, comprising the steps of:

providing twisted leaf shaped blades attached to a ceiling fan motor;

rotating the twisted leaf shaped blades relative to the motor;

generating an airflow of at least approximately 5,000 cfm (cubic feet per minute) below the rotating blades; and running the ceiling fan with the twisted leaf shaped blades with the motor at an efficiency of at least approximately 75 CFM per watt.

14. The method of claim 13, further comprising the step of:

rotating the blades up to approximately 250 RPM.

15. A method of operating a ceiling fan comprising the steps of:

providing aerodynamical leaf shaped blades attached to a ceiling fan motor;

rotating the aerodynamical leaf shaped blades;

generating air flow at least approximately 10% above nonaerodynamical leaf shaped blades; and increasing airflow efficiency at least approximately 10% above nonaerodynamical leaf shaped blades.

16. The method of claim 15, wherein the generating and the increasing steps include the steps of:

generating air flow at least approximately 19% above nonaerodynamical leaf shaped blades; and increasing airflow efficiency at least approximately 19% above nonaerodynamical leaf shaped blades.

17. The method of claim 15, wherein the generating and the increasing steps include the steps of:

generating air flow at least approximately 50% above nonaerodynamical leaf shaped blades; and increasing airflow efficiency at least approximately 50% above nonaerodynamical leaf shaped blades.

18. The method of claim 15, wherein the generating and the increasing steps include the steps of:

generating air flow at least approximately 55% above nonaerodynamical leaf shaped blades; and increasing airflow efficiency at least approximately 55% above nonaerodynamical leaf shaped blades.

19. The method of claim 15, wherein the providing step includes the step of:

providing twisted leaf shaped blades as the aerodynamical leaf shaped blades.

* * * * *